US006244048B1

(12) United States Patent
Tanaka et al.

(10) Patent No.: US 6,244,048 B1
(45) **Date of Patent: *Jun. 12, 2001**

(54) HYDRAULIQUE DRIVE DEVICE

(75) Inventors: Sotaro Tanaka, Ushiku; Gen Yasuda, Ibaraki-ken; Masami Ochiai, Atsugi; Yusaku Nozawa; Hideyo Kato, both of Ibaraki-ken, all of (JP)

(73) Assignee: Hitachi Construction Machinery Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/000,222

(22) PCT Filed: Mar. 31, 1997

(86) PCT No.: PCT/JP97/01103

§ 371 Date: Jan. 23, 1998

§ 102(e) Date: Jan. 23, 1998

(87) PCT Pub. No.: WO97/47826

PCT Pub. Date: Dec. 18, 1997

(30) Foreign Application Priority Data

Jun. 11, 1996 (JP) ..... 8-149117

(51) Int. Cl.[7] ..... F16D 31/02

(52) U.S. Cl. ..... 60/421; 60/429; 60/430; 60/468; 91/454

(58) Field of Search ..... 60/421, 429, 430, 60/422, 426, 465; 91/454

(56) References Cited

U.S. PATENT DOCUMENTS

| | | | | |
|---|---|---|---|---|
| 4,476,679 | * | 10/1984 | Sato | 60/429 |
| 4,646,622 | * | 3/1987 | Ishizaki et al. | 91/454 |
| 4,665,699 | * | 5/1987 | Krusche | 60/452 |
| 4,738,102 | * | 4/1988 | Kropp | 60/427 |
| 5,485,724 | * | 1/1996 | Nozawa et al. | 60/421 |
| 5,540,049 | * | 7/1996 | Lunzman | 60/468 |
| 5,692,377 | * | 12/1997 | Moriya et al. | 60/421 |

FOREIGN PATENT DOCUMENTS

| | | |
|---|---|---|
| 87748 | 9/1983 | (EP) . |
| 59471 | 9/1992 | (EP) . |
| 58-044133 | 3/1983 | (JP) . |
| 6-87467 | 12/1994 | (JP) . |
| WO93/24757 | 9/1993 | (WO) . |

* cited by examiner

*Primary Examiner*—F. Daniel Lopez
(74) *Attorney, Agent, or Firm*—Mattingly, Stanger & Malur

(57) ABSTRACT

A hydraulic drive system for a supersized hydraulic working machine such as a hydraulic excavator includes hydraulic pumps connected to main lines through a delivery line and a supply line. Branch portions from the main line include flow control valves for allowing a hydraulic fluid to flow from the hydraulic pumps toward hydraulic cylinders. A hydraulic reservoir is connected to the main lines through a reservoir line and a drain line. Other branch portions for the drain line include flow control valves for allowing a hydraulic fluid to flow from the hydraulic cylinders toward the hydraulic reservoir. A line branched for the delivery line includes a bypass valve for supplying the hydraulic fluid delivered from the hydraulic pumps to the supply line at a desired flow rate and returning the remaining hydraulic fluid to the hydraulic reservoir.

6 Claims, 8 Drawing Sheets

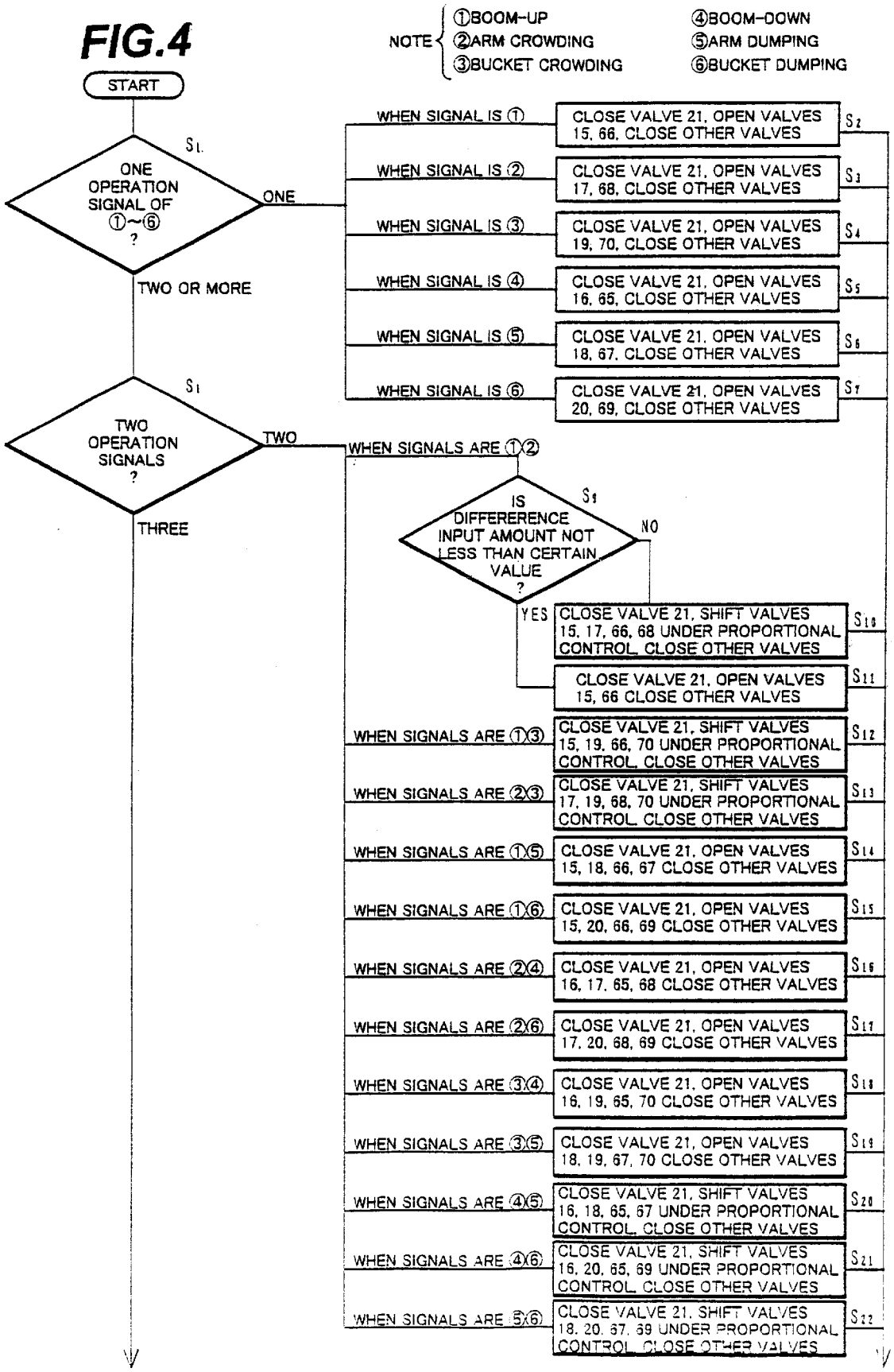
FIG.4
NOTE
①BOOM-UP
②ARM CROWDING
③BUCKET CROWDING
④BOOM-DOWN
⑤ARM DUMPING
⑥BUCKET DUMPING
START
S1
ONE OPERATION SIGNAL OF ①~⑥ ?
ONE
TWO OR MORE
WHEN SIGNAL IS ①
CLOSE VALVE 21, OPEN VALVES 15, 66, CLOSE OTHER VALVES
S2
WHEN SIGNAL IS ②
CLOSE VALVE 21, OPEN VALVES 17, 68, CLOSE OTHER VALVES
S3
WHEN SIGNAL IS ③
CLOSE VALVE 21, OPEN VALVES 19, 70, CLOSE OTHER VALVES
S4
WHEN SIGNAL IS ④
CLOSE VALVE 21, OPEN VALVES 16, 65, CLOSE OTHER VALVES
S5
WHEN SIGNAL IS ⑤
CLOSE VALVE 21, OPEN VALVES 18, 67, CLOSE OTHER VALVES
S6
WHEN SIGNAL IS ⑥
CLOSE VALVE 21, OPEN VALVES 20, 69, CLOSE OTHER VALVES
S7
S8
TWO OPERATION SIGNALS ?
TWO
THREE
WHEN SIGNALS ARE ①②
S9
IS DIFFERERENCE INPUT AMOUNT NOT LESS THAN CERTAIN VALUE ?
NO
YES
CLOSE VALVE 21, SHIFT VALVES 15, 17, 66, 68 UNDER PROPORTIONAL CONTROL, CLOSE OTHER VALVES
S10
CLOSE VALVE 21, OPEN VALVES 15, 66 CLOSE OTHER VALVES
S11
WHEN SIGNALS ARE ①③
CLOSE VALVE 21, SHIFT VALVES 15, 19, 66, 70 UNDER PROPORTIONAL CONTROL, CLOSE OTHER VALVES
S12
WHEN SIGNALS ARE ②③
CLOSE VALVE 21, SHIFT VALVES 17, 19, 68, 70 UNDER PROPORTIONAL CONTROL, CLOSE OTHER VALVES
S13
WHEN SIGNALS ARE ①⑤
CLOSE VALVE 21, OPEN VALVES 15, 18, 66, 67 CLOSE OTHER VALVES
S14
WHEN SIGNALS ARE ①⑥
CLOSE VALVE 21, OPEN VALVES 15, 20, 66, 69 CLOSE OTHER VALVES
S15
WHEN SIGNALS ARE ②④
CLOSE VALVE 21, OPEN VALVES 16, 17, 65, 68 CLOSE OTHER VALVES
S16
WHEN SIGNALS ARE ②⑥
CLOSE VALVE 21, OPEN VALVES 17, 20, 68, 69 CLOSE OTHER VALVES
S17
WHEN SIGNALS ARE ③④
CLOSE VALVE 21, OPEN VALVES 16, 19, 65, 70 CLOSE OTHER VALVES
S18
WHEN SIGNALS ARE ③⑤
CLOSE VALVE 21, OPEN VALVES 18, 19, 67, 70 CLOSE OTHER VALVES
S19
WHEN SIGNALS ARE ④⑤
CLOSE VALVE 21, SHIFT VALVES 16, 18, 65, 67 UNDER PROPORTIONAL CONTROL, CLOSE OTHER VALVES
S20
WHEN SIGNALS ARE ④⑥
CLOSE VALVE 21, SHIFT VALVES 16, 20, 65, 69 UNDER PROPORTIONAL CONTROL, CLOSE OTHER VALVES
S21
WHEN SIGNALS ARE ⑤⑥
CLOSE VALVE 21, SHIFT VALVES 18, 20, 67, 69 UNDER PROPORTIONAL CONTROL, CLOSE OTHER VALVES
S22

HYDRAULIQUE DRIVE DEVICE

FIELD OF THE INVENTION

The present invention relates to a hydraulic drive system for hydraulic working machines such as hydraulic excavators, and more particularly to a hydraulic drive system suitable for supersized construction machines.

BACKGROUND ART

A construction of a conventional hydraulic drive system, i.e., one example of a hydraulic circuit of the hydraulic drive system when applied to, e.g., a supersized hydraulic excavator in excess of 70 t–300 t, is shown in FIG. 9 along with a control system thereof.

Specifically, a hydraulic drive system shown in FIG. 9 comprises a first hydraulic pump 1*a* and a second hydraulic pump 1*b* both driven by a prime mover 4*a*, a third hydraulic pump 3*a* and a fourth hydraulic pump 3*b* both driven by a prime mover 4*b*, boom hydraulic cylinders 5*a*, 5*b* and an arm hydraulic cylinder 6 driven by a hydraulic fluid delivered from the first to fourth hydraulic pumps 1*a*, 1*b*, 3*a*, 3*b*, a bucket hydraulic cylinder 7 driven by the hydraulic fluid delivered from the first and third hydraulic pumps 1*a*, 3*a*, and a swing hydraulic motor 8 driven by the hydraulic fluid delivered from the second and fourth hydraulic pumps 1*b*, 3*b*.

The first hydraulic pump 1*a* is connected to the boom hydraulic cylinders 5*a*, 5*b*, the arm hydraulic cylinder 6 and the bucket hydraulic cylinder 7 through a first boom control valve 10*c*, a first arm control valve 10*b*, and a first bucket control valve 10*a*, respectively. The second hydraulic pump 1*b* is connected to the boom hydraulic cylinders 5*a*, 5*b*, the arm hydraulic cylinder 6 and the swing hydraulic cylinder 8 through a second boom control valve 10*d*, a second arm control valve 10*e*, and a first swing control valve 10*f*, respectively. These control valves 10*a*–10*f* constitute a first control valve group 10.

The third hydraulic pump 3*a* is connected to the boom hydraulic cylinders 5*a*, 5*b*, the arm hydraulic cylinder 6 and the bucket hydraulic cylinder 7 through a third boom control valve 11*c*, a third arm control valve 11*b*, and a second bucket control valve 11*a*, respectively. The fourth hydraulic pump 3*b* is connected to the boom hydraulic cylinders 5*a*, 5*b*, the arm hydraulic cylinder 6 and the swing hydraulic cylinder 8 through a fourth boom control valve 11*d*, a fourth arm control valve 11*e*, and a second swing control valve 11*f*, respectively. These control valves 11*a*–11*f* constitute a second control valve group 11.

The bottom sides of the boom hydraulic cylinders 5*a*, 5*b* are connected to the first and second boom control valves 10*c*, 10*d* through main lines 105 and to the third and fourth boom control valves 11*c*, 11*d* through main lines 125, while the rod sides of the boom hydraulic cylinders 5*a*, 5*b* are connected to the first and second boom control valves 10*c*, 10*d* through main lines 115 and to the third and fourth boom control valves 11*c*, 11*d* through main lines 135. The bottom side of the arm hydraulic cylinder 6 is connected to the first and second arm control valves 10*b*, 10*e* through a main line 116 and to the third and fourth arm control valves 11*b*, 11*e* through a main line 136, while the rod side of the arm hydraulic cylinder 6 is connected to the first and second arm control valves 10*b*, 10*e* through a main line 106 and to the third and fourth arm control valves 11*b*, 11*e* through a main line 126. The bottom side of the bucket hydraulic cylinder 7 is connected to the first bucket control valve 10*a* through a main line 107 and to the second bucket control valve 11*a* through a main line 127, while the rod side of the bucket hydraulic cylinder 7 is connected to the first bucket control valve 10*a* through a main line 117 and to the second bucket control valve 11*a* through a main line 137. Further, the swing hydraulic motor 8 is connected to the first swing control valve 10*f* through main lines 108, 118 and to the second swing control valve 11*f* through main lines 128, 138.

The control system for the hydraulic drive system includes a calculator 31 which receives operation signals output from control levers 32, 33 and outputs command signals to the front control valves 10*a*–*f* and 11*a*–*f*. The control levers 32, 33 are each moved in two orthogonal directions. Operating the control lever 32 in the two orthogonal directions outputs a swing operation signal and an arm operation signal, and operating the control lever 33 in the two orthogonal directions outputs a boom operation signal and a bucket operation signal.

In the above construction shown in FIG. 9, owing to later-described restrictions upon hose diameters available in the market, the main lines 105–107, 115–117, 125–127 and 135–137, i.e., high-pressure lines, are each made up of two or three hoses (or steel pipes, etc.).

DISCLOSURE OF THE INVENTION

The above-explained structure is adapted for a supersized excavator and enables the hydraulic fluid to be supplied at flow rates about twice as much by adding the hydraulic pumps 3*a*, 3*b*, the second control valve group 11 and the main lines 125, 126, 127, 128, 135, 136, 137, 138 to the construction of a conventional large-sized excavator including the hydraulic pumps 1*a*, 1*b*, the first control valve group 10 and the main lines 105, 106, 107, 108, 115, 116, 117, 118.

More specifically, a supersized excavator requires the hydraulic fluid to be supplied in a large amount to drive, in particular, the bottom sides of the hydraulic cylinders 5*a*, 5*b*, 6, 7. Meanwhile, to supply the hydraulic fluid at a super-high flow rate under a super-high pressure requires that each of the main lines be formed of, e.g., a hose or a steel pipe having a super-large diameter. In practice, however, since hoses available in the current market have a maximum diameter of about 2 inches, the main line must be constructed by arranging a plurality of hoses or the likes (e.g., two or three per main line) side by side, as mentioned above. This results in that the allowable capacity of the main line is restricted for a supply/return flow rate demanded by the hydraulic actuator and a relatively large pressure loss is generated in each of the hoses. Accordingly, in the entire hydraulic circuit of the supersized excavator including long lines made of up hoses, steel pipes or the likes, control valves, etc., a very large pressure loss is generated and an energy loss is increased correspondingly. Another problem is that the operating speed of the hydraulic actuator is lowered and the working efficiency is reduced.

Further, to arrange a plurality of hoses or the likes to construct one main line and install two or three main lines on each of the bottom and rod sides of the hydraulic cylinders 5*a*, 5*b*, 6, 7 in the supersized excavator is not easy in itself. An additional problem is that the presence of many hoses or the likes makes poor visibility from a cab toward the lateral and rear sides of a working machine such as a hydraulic excavator.

An object of the present invention is to provide a hydraulic drive system which can reduce the total length of lines made up of hoses, steel pipes or the likes in a supersized hydraulic working machine, and can lessen a pressure loss in the entirety of a hydraulic circuit.

To achieve the above object, according to the present invention, there is provided a hydraulic drive system equipped on a hydraulic working machine comprising a working machine body and a front device made up of a plurality of front members coupled to the working machine body to be rotatable in the vertical direction, the hydraulic drive system comprising a hydraulic reservoir provided on the working machine body, at least one hydraulic pump, a plurality of hydraulic cylinders for respectively driving the plurality of front members, a plurality of flow control valves provided on the working machine body for respectively introducing a hydraulic fluid delivered from the hydraulic pump to the plurality of hydraulic cylinders and controlling operation of the corresponding hydraulic cylinders, and a plurality of first connecting lines provided on the front device for respectively connecting the flow control valves and ones of the bottom and rod sides of the corresponding hydraulic cylinders, wherein the hydraulic drive system further comprises at least one other hydraulic pump provided on the working machine body separately from the aforesaid hydraulic pump, a delivery line to which is introduced a hydraulic fluid delivered from the other hydraulic pump and a reservoir line for introducing the hydraulic fluid to the hydraulic reservoir, the delivery line and the reservoir line being both provided on the working machine body, a second connecting line provided on the front device and connected at one side thereof to the delivery line, a plurality of first lines provided on the front device and having one sides connected respectively to the other side of the second connecting line so as to be branched therefrom, the other sides of the first lines on the opposite side to the one sides connected respectively to at least those of the plurality of first connecting lines which are connected to the bottom sides of the hydraulic cylinders, a plurality of first flow control means provided respectively in the plurality of first lines for allowing the hydraulic fluid to flow from the other hydraulic pump toward the hydraulic cylinders through variable throttles which control respective flows of the hydraulic fluid to desired throttled flow rates, but cutting off flows of the hydraulic fluid from the hydraulic cylinders toward the other hydraulic pump, a third connecting line provided on the front device and connected at one side thereof to the reservoir line, a plurality of second lines provided on the front device and having one sides connected respectively to the other side of the third connecting line so as to be branched therefrom, the other sides of the second lines on the opposite side to the one sides connected respectively to at least those of the plurality of first connecting lines which are connected to the bottom sides of the hydraulic cylinders, a plurality of second flow control means provided respectively in the plurality of second lines for allowing the hydraulic fluid to flow from the hydraulic cylinders toward the third connecting line through variable throttles which control respective flows of the hydraulic fluid to desired throttled flow rates, but cutting off flows of the hydraulic fluid from the third connecting line toward the hydraulic cylinders, and third flow control means provided in a line branched from the delivery line within the working machine body for supplying the hydraulic fluid delivered from the other hydraulic pump to the first lines at a desired flow rate and returning the remaining hydraulic fluid to the hydraulic reservoir.

Considering first the extending operation of the hydraulic cylinders, for example, the hydraulic fluid delivered from the at least one hydraulic pump is supplied to those of the first connecting lines, which are connected to the bottom sides of the hydraulic cylinders, through the plurality of control valve switching valves. At this time, the hydraulic fluid delivered from the at least one other hydraulic pump is also supplied to those of the first connecting lines, which are connected to the bottom sides of the hydraulic cylinders, through the delivery line, the second connecting line and the first lines connected to the second connecting line so as to be branched therefrom at flow rates adjusted by the third flow control means provided in the line branched from the delivery line and the first flow control means provided in the first lines, without passing the flow control valves. This enables the hydraulic fluid to be introduced at a super-high flow rate to the bottom sides of the corresponding hydraulic cylinders in, e.g., a supersized excavator. As a result, the hydraulic cylinders can be driven in the extending direction to operate the front members.

Considering next the contracting operation of the hydraulic cylinders, for example, part of the return hydraulic fluid from the bottom sides of the hydraulic cylinders is introduced to the reservoir line from those of the first connecting lines, which are connected to the bottom sides of the hydraulic cylinders, through the plurality of flow control valves. At this time, the remaining return hydraulic fluid from the bottom sides of the hydraulic cylinders is introduced to the reservoir line through the first connecting lines connected to the bottom sides of the hydraulic cylinders, the second lines connected to the third connecting line so as to be branched therefrom, and the third connecting line at flow rates adjusted by the second flow control means provided in the second lines. By thus employing two return routes, the hydraulic cylinders can be driven in the direction to contract for operating the front members, while draining the return hydraulic fluid at a super-large flow rate from the bottom sides of the corresponding hydraulic cylinders in, e.g., the supersized excavator.

Here, the conventional structure can also be made adapted for the above-stated extending and contracting operation of the hydraulic cylinders in a supersized excavator with a super-high flow rate, for example, by simply adding at least one hydraulic pump, a plurality of flow control valves and a plurality of first connecting lines such that the downstream ends of the first connecting lines are connected to the first connecting lines which are originally existing. In such a case, however, on the bottom side of each of the hydraulic cylinders, i.e., a boom cylinder, an arm cylinder and a bucket cylinder, provided on the front device separately in this order from the side of the working machine body, there are disposed, e.g., two first connecting lines as high-pressure lines respectively led from both a first flow control valve group and a second flow control valve group. Accordingly, the number of high-pressure lines on the front device from the side of the working machine body to the bottom sides of the hydraulic cylinders, i.e., the boom cylinder, the arm cylinder and the bucket cylinder, is a total of six in an area of the front device nearer to the body side than the boom cylinder; i.e., two first connecting lines to the bottom side of the boom cylinder, two first connecting lines to the bottom side of the arm cylinder and two first connecting lines to the bottom side of the bucket cylinder, is a total of four in an area of the front device farther from the body side than the boom cylinder but nearer to the body side than the arm cylinder; i.e., two first connecting lines to the bottom side of the arm cylinder and two first connecting lines to the bottom side of the bucket cylinder, and is two in an area of the front device farther from the body side than the arm cylinder but nearer to the body side than the bucket cylinder; i.e., two first connecting lines to the bottom side of the bucket cylinder.

In the present invention, by contrast, the hydraulic pump, the flow control valves, the other hydraulic pump, the delivery line, the reservoir line and the third flow control means are installed on the working machine body, whereas the first connecting lines, the second connecting line, the third connecting line, the first lines, the second lines, the first flow control means, the second flow control means and the hydraulic cylinders are installed on the front device. The number of high-pressure lines led to the bottom sides of the respective hydraulic cylinders, which are particularly problematic from the viewpoint of pressure loss, is therefore reduced in most areas of the front device as compared with the case of employing the conventional structure, by locating the connected positions where the first and second lines are branched from the second and third connecting lines, respectively, near the corresponding hydraulic cylinders such that the first and second lines are branched to the bottom side of the boom cylinder from the second and third connecting lines in positions near the boom cylinder, are branched to the bottom side of the arm cylinder from the second and third connecting lines in further advanced positions near the arm cylinder, and are branched to the bottom side of the bucket cylinder from the second and third connecting lines in still further advanced positions near the bucket cylinder. More specifically, besides the third connecting line as a low-pressure line, the number of high-pressure lines led to the bottom sides of the hydraulic cylinders is reduced in two areas of the front device as follows. In the area of the front device nearer to the body side than the vicinity of the boom cylinders, there are a total of four lines; i.e., one first connecting line to the bottom side of the boom cylinder, one first connecting line to the bottom side of the arm cylinder, one first connecting line to the bottom side of the bucket cylinder, and one second connecting line. In the area of the front device farther from the body side than the vicinity of the boom cylinder but nearer to the body side than the vicinity of the arm cylinder, there are a total of three lines; i.e., one first connecting line to the bottom side of the arm cylinder, one first connecting line to the bottom side of the bucket cylinder, and one second connecting line. Since the number of hoses (or steel pipes, etc.) required for all the high-pressure lines can be thus reduced and the total length of the high-pressure lines can be shortened correspondingly, the pressure loss in the entire high-pressure lines can be reduced. In the area of the front device farther from the body side than the vicinity of the arm cylinder but nearer to the body side than the vicinity of the bucket cylinder, there are a total of two lines; i.e., one first connecting line to the bottom side of the bucket cylinder and one second connecting line. Thus, in that area, the number of high-pressure lines required is not more than but the same as conventional, and therefore the pressure loss is not larger than conventional.

There is also provided a hydraulic drive system preferably modified from the above system in that the other side of at least one of the plurality of first lines on the opposite side to the one side connected to the second connecting line is connected to that of the plurality of first connecting lines which is connected to the rod side of the hydraulic cylinder, and the first flow control means provided in the at least one first line allows the hydraulic fluid to flow from the other hydraulic pump toward the rod side of the hydraulic cylinder through a variable throttle for controlling a flow of the hydraulic fluid to a desired throttled flow rate, but cuts off a flow of the hydraulic fluid from the rod side of the hydraulic cylinder toward the other hydraulic pump.

There is further provided a hydraulic drive system preferably modified from the above system in that the other side of at least one of the plurality of first lines on the opposite side to the one side connected to the second connecting line is connected to that of the plurality of first connecting lines which is connected to the rod side of the hydraulic cylinder, the first flow control means provided in the at least one first line allows the hydraulic fluid to flow from the other hydraulic pump toward the rod side of the hydraulic cylinder through a variable throttle for controlling a flow of the hydraulic fluid to a desired throttled flow rate, but cuts off a flow of the hydraulic fluid from the rod side of the hydraulic cylinder toward the other hydraulic pump, the other side of at least one of the plurality of second lines on the opposite side to the one side connected to the third connecting line is connected to that of the plurality of first connecting lines to which the at least one first line is connected and which is connected to the rod side of the hydraulic cylinder, and the second flow control means provided in the at least one second line allows the hydraulic fluid to flow from the rod side of the hydraulic cylinder toward the hydraulic reservoir through a variable throttle for controlling a flow of the hydraulic fluid to a desired throttled flow rate, but cuts off a flow of the hydraulic fluid from the hydraulic reservoir toward the rod side of the hydraulic cylinder.

Considering first the extending operation of the hydraulic cylinders, for example, the hydraulic fluid delivered from the at least one hydraulic pump is joined with the hydraulic fluid delivered from the at least one other hydraulic pump, and is then supplied to the bottom sides of the hydraulic cylinders through the first connecting lines. At this time, part of the return hydraulic fluid from the rod sides of the hydraulic cylinders is introduced to the reservoir line from those of the first connecting lines, which are connected to the rod sides of the hydraulic cylinders, through the plurality of flow control valves, while the remaining return hydraulic fluid is introduced to the reservoir line through the first connecting lines connected to the rod sides of the hydraulic cylinders, the second lines connected to the third connecting line so as to be branched therefrom, and the third connecting line at flow rates adjusted by the second flow control means provided in the second lines.

Considering next the contracting operation of the hydraulic cylinders, for example, the hydraulic fluid delivered from the at least one hydraulic pump is supplied to those of the first connecting lines, which are connected to the rod sides of the hydraulic cylinders, through the plurality of flow control valves. At this time, the hydraulic fluid delivered from the at least one other hydraulic pump is also supplied to those of the first connecting lines, which are connected to the rod sides of the hydraulic cylinders, through the delivery line, the second connecting line and the first lines connected to the second connecting line so as to be branched therefrom at flow rates adjusted by the third flow control means provided in the line branched from the delivery line and the first flow control means provided in the first lines, without passing the flow control valves. The return hydraulic fluid from the bottom sides of the corresponding hydraulic cylinders in this case is branched to one part that is introduced to the plurality of flow control valves through of the first connecting lines which are connected to the bottom sides of the hydraulic cylinders, and the other part that is introduced to the third connecting line through the second lines, both the parts being finally introduced to the reservoir line.

Here, when the conventional structure is made adapted for the above-stated extending and contracting operation of the hydraulic cylinders in a supersized excavator with a super-high flow rate, for example, the number of high-pressure lines to be provided on the front device in its areas from the side of the working machine body to the bottom and rod sides of the hydraulic cylinders a total of twelve in an area of the front device nearer to the body side than the boom cylinder; i.e., four first connecting lines to the bottom and rod sides of the boom cylinder, four first connecting lines to the bottom and rod sides of the arm cylinder and four first connecting lines to the bottom and rod sides of the bucket cylinder, is a total of eight in an area of the front device farther from the body side than the boom cylinder but nearer to the body side than the arm cylinder; i.e., four first connecting lines to the bottom and rod sides of the arm cylinder and four first connecting lines to the bottom and rod sides of the bucket cylinder, and is a total of four in an area of the front device farther from the body side than the arm cylinder but nearer to the body side than the bucket cylinder; i.e., four first connecting lines to the bottom and rod sides of the bucket cylinder.

In the above construction of the present invention, by contrast, the number of high-pressure lines required on both the bottom and rod sides of the respective hydraulic cylinders can be reduced by locating the connected positions where the first and second lines are branched from the second and third connecting lines, respectively, near the corresponding hydraulic cylinders. More specifically, in the area of the front device nearer to the body side than the vicinity of the boom cylinders, there are a total of seven lines; i.e., two first connecting lines to the bottom and rod sides of the boo m cylinder, two first connecting lines to the bottom and rod sides of the arm cylinder, two first connecting lines to the bottom and rod sides of the bucket cylinder, and one second connecting line. In the area of the front device farther from the body side than the vicinity of the boom cylinder but nearer to the body side than the vicinity of the arm cylinder, there are a total of five lines; i.e., two first connecting lines to the bottom and rod sides of the arm cylinder , two first connecting lines to the bottom and rod sides of the bucket cylinder, and one second connecting line. In the area of the front device farther from the body side than the vicinity of the arm cylinder but nearer to the body side than the vicinity of the bucket cylinder, there are a total of three lines; i.e., two first connecting lines to the bottom and rod sides of the bucket cylinder and one second connecting line. As a result, the pressure loss produced in the entire high-pressure lines can be further reduced.

There is further provided a hydraulic drive system preferably modified from the above system in further comprising control means for controlling the plurality of flow control valves and the first flow control means to be driven in correlated manners so that just before or after the hydraulic fluid through at least one of the plurality of flow control valves is sufficiently supplied to the corresponding first connecting line, the hydraulic fluid through the corresponding first flow control means starts to be supplied to the corresponding first connecting line.

With this feature, in fine operation where the hydraulic fluid is supplied at a very small flow rate through the flow control valves, no hydraulic fluid is supplied through the first flow control means. Then, at the time or thereabout when the hydraulic fluid is sufficiently supplied through the flow control valves, the hydraulic fluid is started to be supplied through the first flow control means. It is thus possible to suppress a shock that would be otherwise caused upon any actuator being quickly sped-up during the fine operation, and make the operator feel less awkward in that occasion.

There is further provided a hydraulic drive system preferably modified from the above system in further comprising control means for driving the first flow control means disposed in at least one of the plurality of first lines which is connected to the rod side of the hydraulic cylinder, thereby supplying the hydraulic fluid from the other hydraulic pump to the rod side of the hydraulic cylinder, and at the same time driving the second flow control means disposed in the second line which is connected to the bottom side of the corresponding hydraulic cylinder, thereby draining the return hydraulic fluid from the bottom side of the corresponding hydraulic cylinder to the hydraulic reservoir.

There is further provided a hydraulic drive system preferably modified from the above system in further comprising a plurality of operating means for controlling respective stroke amounts of the plurality of flow control valves and control means for controlling the flow control valves and the first flow control means to be driven in correlated manners, the control means making control such that in a first input amount area where input amounts of the operating means are relatively small, the flow control valves are moved over strokes at a relatively small ratio with respect to an increase of the input amounts of the operating means, thereby supplying the hydraulic fluid to the corresponding first connecting lines, and that in a second input amount area where the input amounts of the operating means are relatively large, the flow control valves are moved over strokes at a relatively large ratio with respect to an increase of the input amounts of the operating means, thereby supplying the hydraulic fluid to the corresponding first connecting lines, and the first flow control means are moved over strokes at a predetermined ratio with respect to an increase of the input amounts of the operating means, thereby supplying the hydraulic fluid to the corresponding first connecting lines through the corresponding first lines.

Specifically, control at a very small flow rate is performed by moving only the flow control valves over strokes at a relatively small ratio with respect to an increase of the input amounts of the operating means in the first input amount area. After there has reached a flow rate exceeding a certain level, flow rate control is performed through both the flow control valves and the first flow control means in the second input amount area by not only moving the flow control valves over strokes at a relatively large ratio with respect to an increase of the input amounts of the operating means, but also moving the first flow control means over strokes at a predetermined ratio. It is thus possible to suppress a shock that would be otherwise caused upon any actuator being quickly sped-up during the fine operation, and make the operator feel less awkward in that occasion.

BRIEF DESCRIPTION OF THE DRAWINGS

FIG. 4 is a flowchart showing control functions of the calculator shown in FIG. 1.

BEST MODE FOR CARRYING OUT THE INVENTION

An embodiment of a hydraulic drive system according to the present invention will be described hereunder with reference to the drawings.

Figure 7:
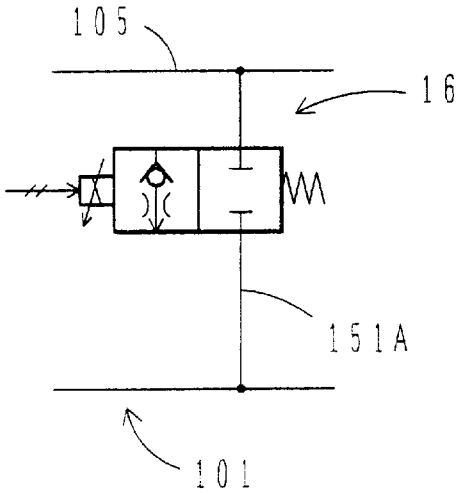
FIG. 7 is a detailed view showing the construction of a flow control valve.
Figure 8:
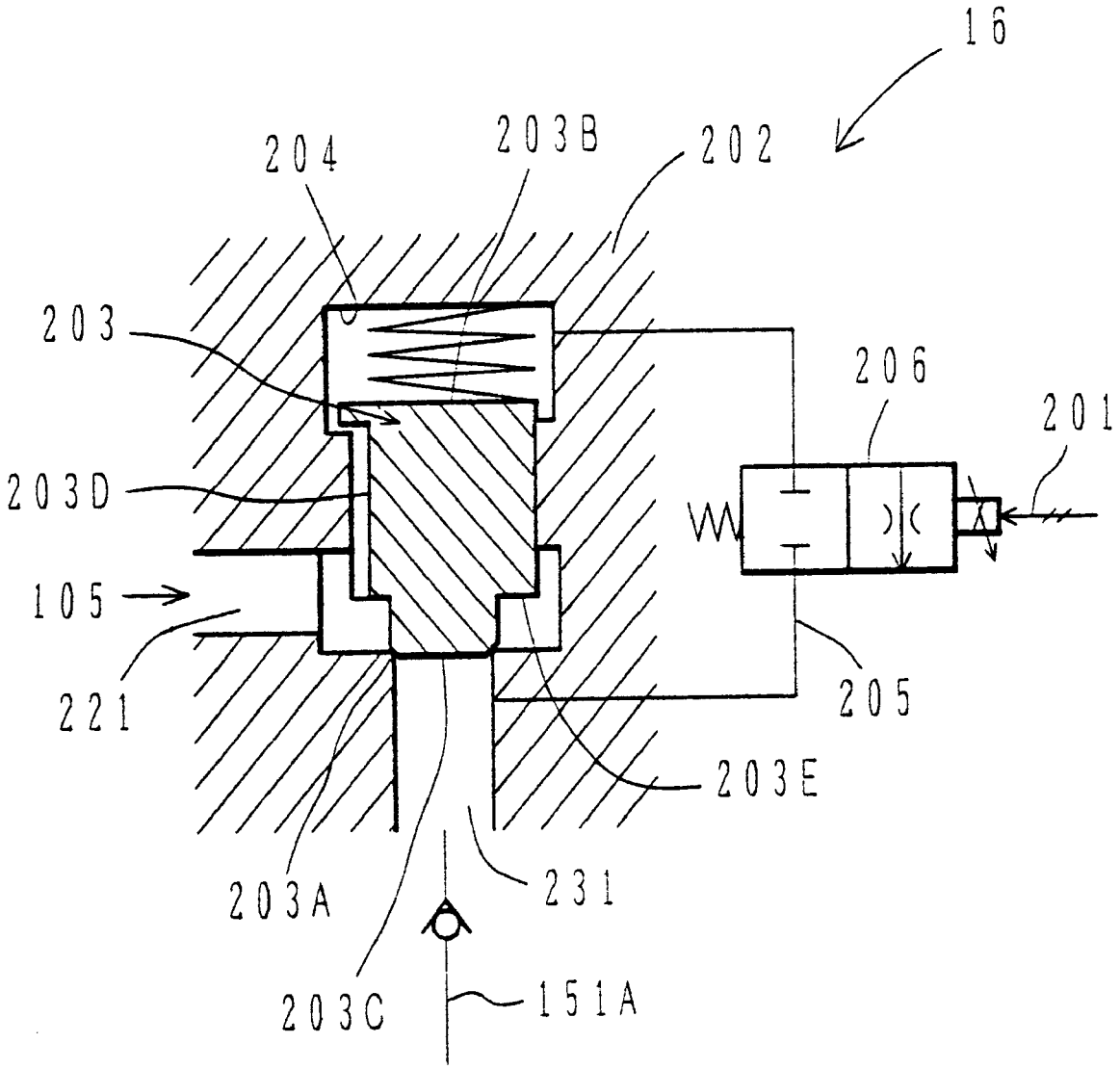
FIG. 8 is a view showing the structure of a seat valve corresponding to the construction of FIG. 7.
Figure 9:
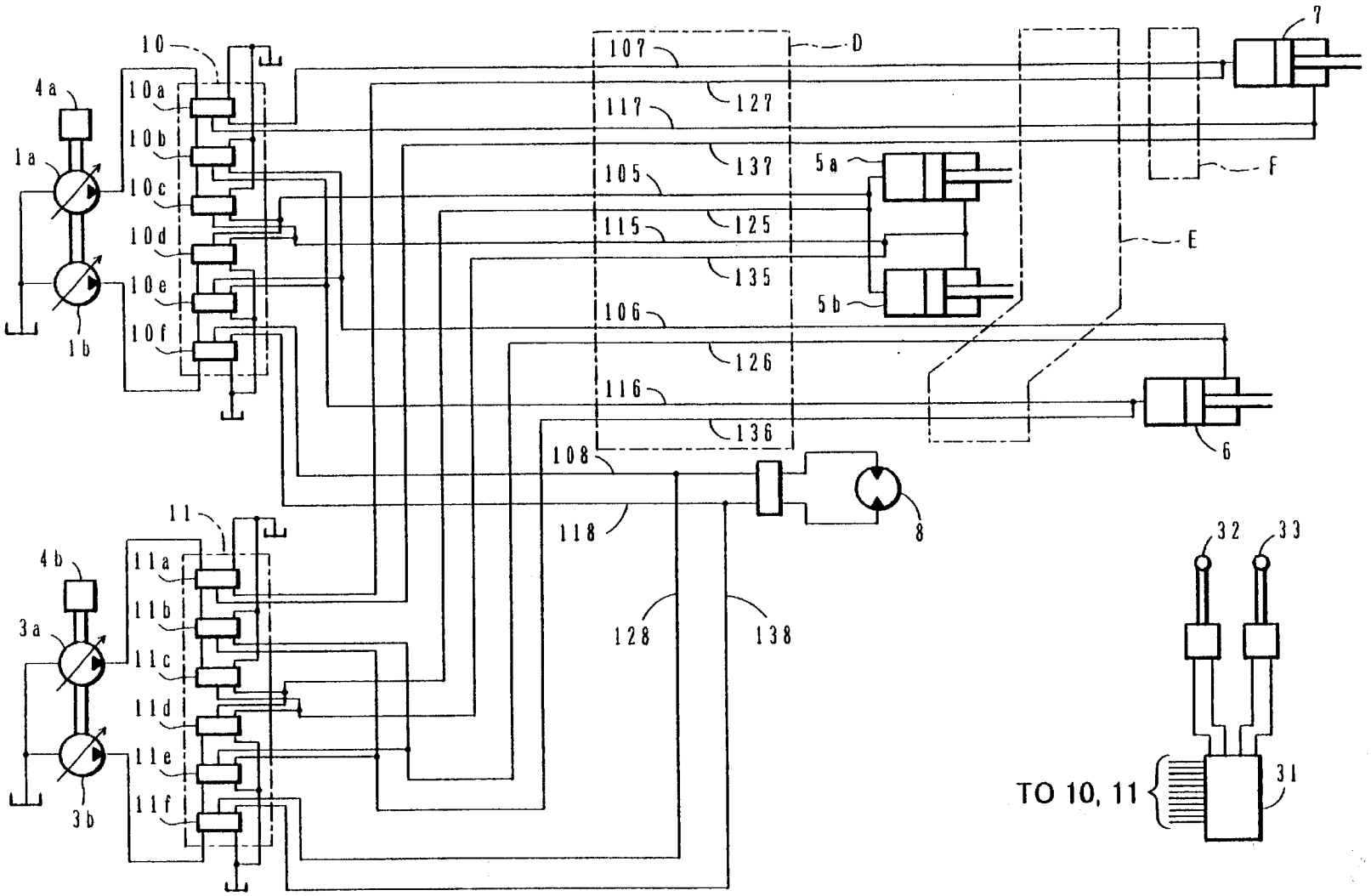
FIG. 9 PRIOR ART
FIG. 9 is a diagram showing a hydraulic circuit illustrative of the construction of a conventional hydraulic drive system which is applied to a supersized hydraulic excavator, along with a control system thereof.

Some embodiments of the present invention will be described with reference to FIGS. 1–8. In these drawings, equivalent members as those in FIG. 9 showing the conventional structure are denoted by the same reference numbers. This embodiment represents the case where the present invention is applied to a supersized hydraulic excavator in excess of 70 t–300 t.

Figure 1:
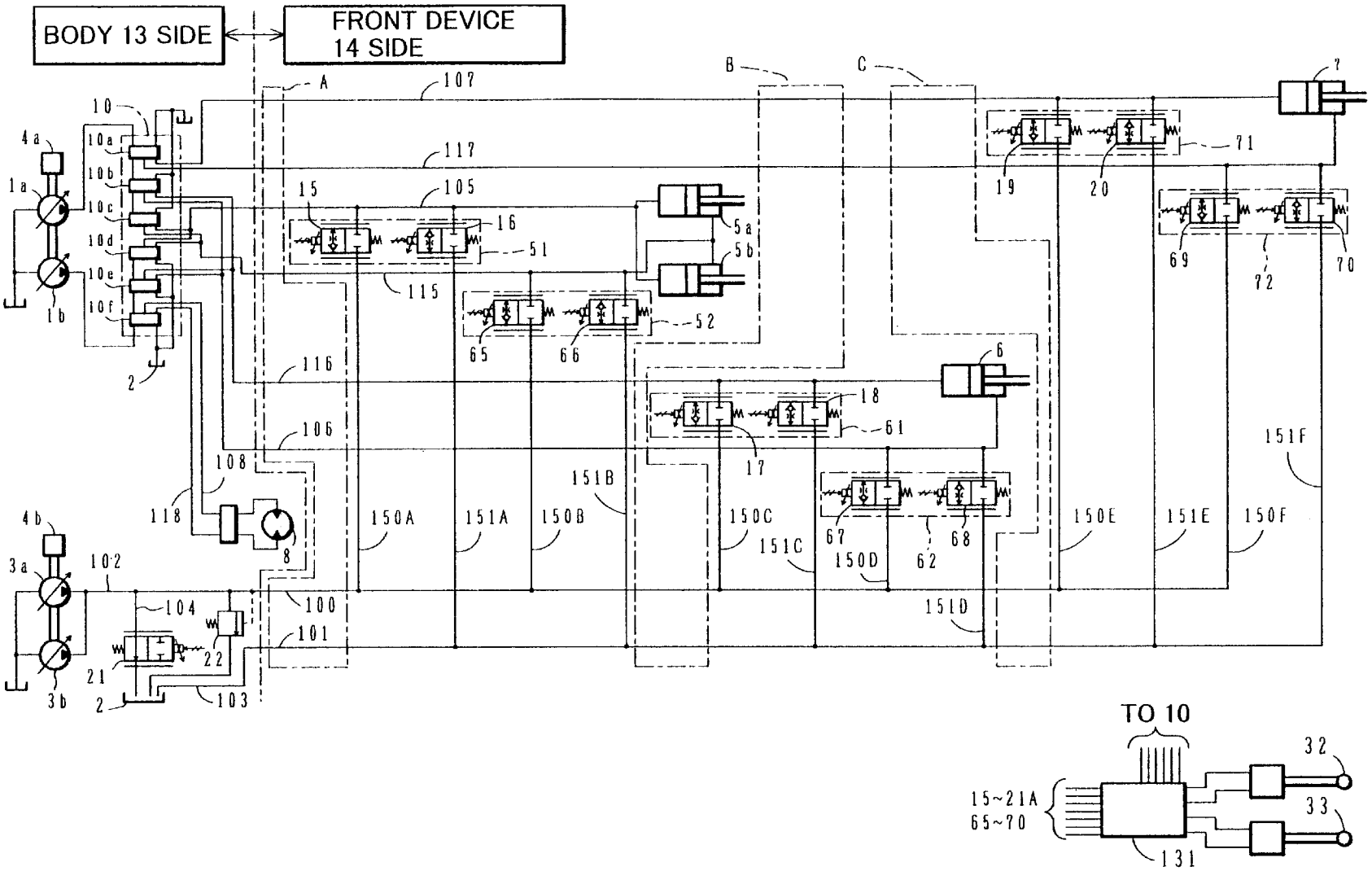
FIG. 1 is a diagram showing a hydraulic circuit illustrative of the construction of a hydraulic drive system according to one embodiment of the present invention, along with a control system thereof.

First of all, a hydraulic circuit illustrative of the construction of the hydraulic drive system according to this embodiment is shown in FIG. 1 along with a control system thereof.

Specifically, the hydraulic drive system shown in FIG. 1 comprises a first hydraulic pump 1*a* and a second hydraulic pump 1*b* both driven by a prime mover 4*a*, a third hydraulic pump 3*a* and a fourth hydraulic pump 3*b* both driven by a prime mover 4*b*, boom hydraulic cylinders 5*a*, 5*b* and an arm hydraulic cylinder 6 driven by a hydraulic fluid delivered from the first and second hydraulic pumps 1*a*, 1*b*, a bucket hydraulic cylinder 7 driven by the hydraulic fluid delivered from the first hydraulic pump 1*a*, and a swing hydraulic motor 8 driven by the hydraulic fluid delivered from the second hydraulic pump 1*b*.

The first hydraulic pump 1*a* is connected to the boom hydraulic cylinders 5*a*, 5*b*, the arm hydraulic cylinder 6 and the bucket hydraulic cylinder 7 through a first boom control valve 10*c*, a first arm control valve 10*b*, and a first bucket control valve 10*a*, respectively. The second hydraulic pump 1*b* is connected to the boom hydraulic cylinders 5*a*, 5*b*, the arm hydraulic cylinder 6 and the swing hydraulic cylinder 8 through a second boom control valve 10*d*, a second arm control valve 10*e*, and a swing control valve 10*f*, respectively. These control valves 10*a*–10*f* constitute a first control valve group 10.

The bottom sides of the boom hydraulic cylinders Sa, 5*b* are connected to the first and second boom control valves 10*c*, 10*d* through a main line 105 as one first connecting line, while the rod sides of the boom hydraulic cylinders-5*a*, 5*b* are connected to the first and second boom control valves 10*c*, 10*d* through a main line 115 as a first connecting line. The bottom side of the arm hydraulic cylinder 6 is connected to the first and second arm control valves 10*b*, 10*e* through a main line 116 as a first connecting line, while the rod side of the arm hydraulic cylinder 6 is connected to the first and second arm control valves 10*b*, 10*e* through a main line 106 as a first connecting line. The bottom side of the bucket hydraulic cylinder 7 is connected to the first bucket control valve 10*a* through a main line 107 as a first connecting line, while the rod side of the bucket hydraulic cylinder 7 is connected to the first bucket control valve 10*a* through a main line 117 as a first connecting line. Further, the swing hydraulic motor 8 is connected to the swing control valve 10*f* through main lines 108, 118 as a first connecting lines.

On the other hand, the third and fourth hydraulic pumps 3*a*, 3*b* are connected to the main lines 105, 115. 116, 106, 107, 117 through a delivery line 102 to which the hydraulic fluid delivered from those hydraulic pumps 3*a*, 3*b* is first introduced, a supply line 100 as a second connecting line which is provided on a front device 14 (described later) of the hydraulic excavator and connected at one side (left side in the drawing) thereof to the delivery line 102, and respective branch lines 150A, B, C, D, E, F as first lines which are provided on the front device 14 (described later) and connected to the other side of the supply line 100 in such a manner as being branched from the supply line 100 successively. Of those branch lines 150A–F, the branch lines 150A, C, E include first flow control means, e.g., flow control valves 15, 17, 19 constructed of solenoid proportional valves with pressure compensating functions, respectively, which allow the hydraulic fluid to flow from the third and fourth hydraulic pumps 3*a*, 3*b* toward the bottom sides of the hydraulic cylinders 5*a*, 5*b*, 6, 7 through variable throttles for controlling respective flows of the hydraulic fluid to desired throttled flow rates, but cut off reverse flows of the hydraulic fluid, and the branch lines 150B, D, F include first flow control means, e.g., flow control valves 65, 67, 69 constructed of solenoid proportional valves with pressure compensating functions, respectively, which allow the hydraulic fluid to flow from the third and fourth hydraulic pumps 3*a*, 3*b* toward the rod sides of the hydraulic cylinders 5*a*, 5*b*, 6, 7 through variable throttles for controlling respective flows of the hydraulic fluid to desired throttled flow rates, but cut off reverse flows of the hydraulic fluid.

In this connection, the positions at which the branch lines 150A–F are branched from the supply line 100 are located near the corresponding hydraulic cylinders (see also FIG. 2 described later). Specifically, the branch lines 150A, B to the boom cylinders 5*a*, 5*b* are branched from the supply line 100 in positions near the boom cylinders 5*a*, 5*b*, the branch lines 150C, D to the arm cylinder 6 are branched from the supply line 100 in further advanced positions near the arm cylinder 6, and the branch lines 150E, F to the bucket cylinder 7 are branched from the supply line 100 in still further advanced positions near the bucket cylinder 7.

A hydraulic reservoir 2 is connected to the main lines 105, 115. 116, 106, 107, 117 through a reservoir line 103 for introducing the return hydraulic fluid to a hydraulic reservoir 2, a drain line 101 as a low-pressure third connecting line which is provided on the front device 14 (described later) of the hydraulic excavator and connected at one side (left side in the drawing) thereof to the reservoir line 103, and respective branch lines 151A, B, C, D, E, F as second lines which are provided on the front device 14 (described later) and connected to the other side of the drain line 101 in such a manner as being branched from the drain line 101 successively. Of those branch lines 151A–F, the branch lines 151A, C, E include three second flow control means, e.g., flow control valves 16, 18, 20 constructed of solenoid proportional valves with pressure compensating functions, respectively, which allow the (return) hydraulic fluid to flow from the bottom sides of the hydraulic cylinders 5*a*, 5*b*, 6, 7 toward the hydraulic reservoir 2 through variable throttles for controlling respective flows of the hydraulic fluid to desired throttled flow rates, but cut off reverse flows of the hydraulic fluid, and the branch lines 151B, D, F include three second flow control means, e.g., flow control valves 66, 68, 70 constructed of solenoid proportional valves, respectively, which allow the (return) hydraulic fluid to flow from the rod sides of the hydraulic cylinders 5*a*, 5*b*, 6, 7 toward the hydraulic reservoir 2 through variable throttles for controlling respective flows of the hydraulic fluid to desired throttled flow rates, but cut off reverse flows of the hydraulic fluid.

In this connection, the positions at which the branch lines 151A–F are branched from the drain line 101 are located near the corresponding hydraulic cylinders (see also FIG. 2 described later). Specifically, the branch lines 151E, F from the bucket cylinder 7 join with the drain line 101 in a position near the bucket cylinder 7, the branch lines 151C, D from the arm cylinder 6 join with the drain line 101 in positions near the arm cylinder 6 further backing toward a body 13 (described later) of the hydraulic excavator, and the branch lines 151A, B from the boom cylinders 5*a*, 5*b* join with the drain line 101 in positions near the boom cylinders 5*a*, Sb still further backing toward the body 13.

Of the above flow control valves 15–20 and 65–70, paris of the flow control valves 15, 16, the flow control valves 17, 18, the flow control valves 19, 20, the flow control valves 65, 66, the flow control valves 67, 68, and the flow control valves 69, 70 which are disposed in relatively close relation constitute flow control valve devices 51, 61, 71 (see also FIG. 2 described later) and 52, 62, 72.

Further, a line 104 is branched from the delivery line 102 and includes third flow control means, e.g., a bypass valve 21 constructed of a solenoid proportional valve with a pressure compensating function, for supplying the hydraulic fluid delivered from the third and fourth hydraulic pumps 3*a*, 3*b* to the supply line 100 at a desired flow rate and returning the remaining hydraulic fluid to the hydraulic reservoir 2. Additionally, between the delivery line 102 and the reservoir line 103, there is disposed a relief valve 22 for specifying the maximum pressure in the supply line 100 as a high-pressure line.

The first to fourth hydraulic pumps 1*a*, 1*b*, 3*a*, 3*b*, the control valve group 10, the delivery line 102, the reservoir line 103, the line 104, the bypass valve 21, the relief valve 22, etc. are provided on the body 13 as shown in FIG. 1, whereas the hydraulic cylinders 5*a*, 5*b*, 6, 7, the supply line 100, the drain line 101, the branch lines 150A–F and 151A–F, etc. are provided on the front device 14 as shown in FIG. 1. Also, in the above construction, the third and fourth hydraulic pumps 3*a*, 3*b* each constitute the other hydraulic pump provided on the body 13 separately from the first and second hydraulic pumps 1*a*, 1*b*.

In the above construction shown in FIG. 1, the high-pressure lines, i.e., the main lines 105–107, 115–117, the branch lines 150A–F and the supply line 100, are each made up of two or three hoses (or steel pipes, etc.). The low-pressure lines, i.e., the branch lines 151A–F and the drain line 101, may be each formed of one large-diameter hose (or a steel pipe, etc.).

Figure 2:
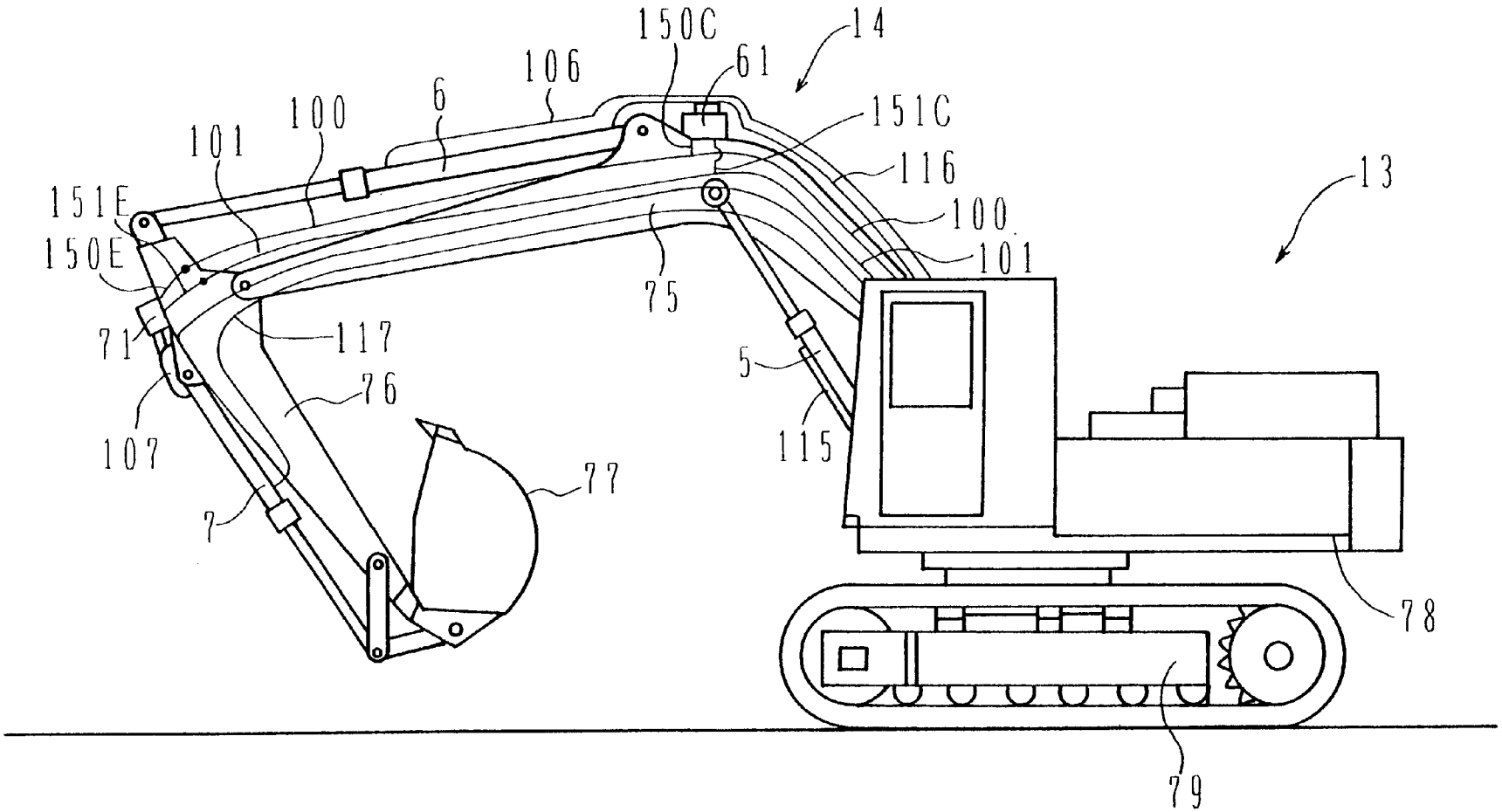
FIG. 2 is a side view showing the entire structure of a hydraulic excavator which is driven by the hydraulic drive system of FIG. 1.

FIG. 2 is a side view showing the entire structure of a hydraulic excavator which is driven by the hydraulic drive system described above. In FIG. 2, the hydraulic excavator is the backhoe type and comprises the body 13 as a working machine body, and the front device 14 made up of a plurality of front members, i.e., a boom 75, an arm 76 and a bucket 77, coupled to the body 13 to be rotatable in the vertical direction. The boom hydraulic cylinder 5, the arm hydraulic cylinder 6 and the bucket hydraulic cylinder 7 are mounted respectively on the boom 75, the arm 76 and the bucket 77, as shown, and perform the operations of boom-up, arm crowding and bucket crowding when actuated to extend. Also, the swing hydraulic motor 8 shown in FIG. 1 is mounted in a swing base 78 to swing it. Further, though not shown in FIG. 1, travel hydraulic motors for driving traveling devices 79 of the hydraulic excavator are connected to the first and second hydraulic pumps 1*a*, 1*b* through respective control valves.

The main lines 105, 115, 106, 116, 107, 117, the supply line 100, the drain line 101 and the flow control valve devices 51, 61, 71, 52, 62, 72 are associated with the front device 14 (but the main line 105 and the flow control valve devices 51, 52, 62, 72 are not shown for the sake of simplicity).

Returning to FIG. 1, a calculator 131 is provided as the control system for the hydraulic drive system. The calculator 131 receives operation signals outputed from the control levers 32, 33 and outputs command signals to the control valves 10*a–f*, the flow control valves 15–20, 65–70 and the bypass valve 21. The control levers 32, 33 are each moved in two orthogonal directions. For example, operating the control lever 32 in the two orthogonal directions outputs a swing operation signal and an arm operation signal, and operating the control lever 33 in the two orthogonal directions outputs a boom operation signal and a bucket operation signal.

Figure 3:
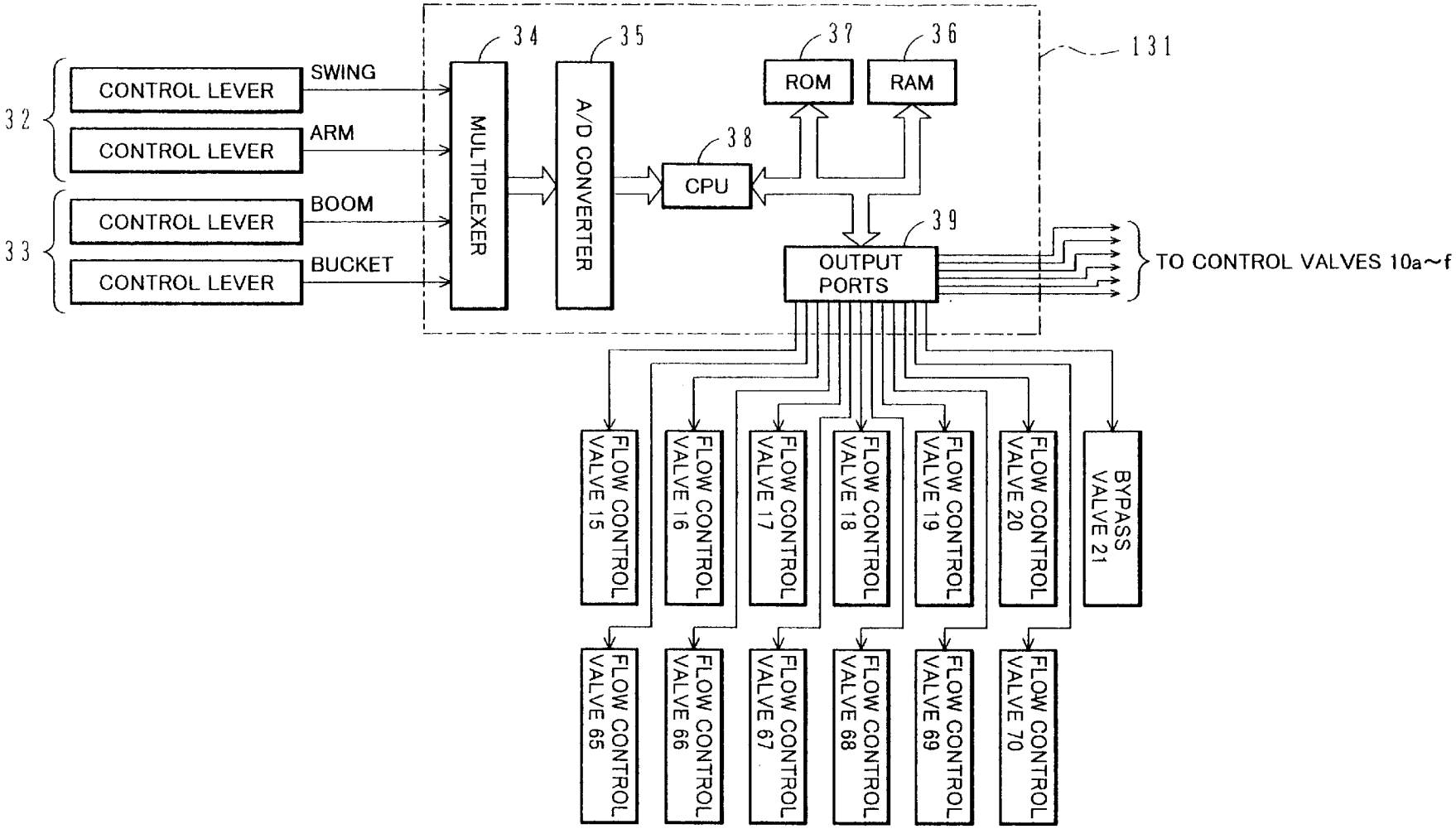
FIG. 3 is a functional block diagram showing detailed functions of a calculator shown in FIG. 1.

FIG. 3 shows a functional block diagram showing detailed functions of the calculator 131.

As shown in FIG. 3, the calculator 131 comprises a multiplexer 34 for receiving the operation signals from the control levers 32, 33 and outputting any of the operation signals after proper switching and selection, an A/D converter 35 for converting the operation signal output from the multiplexer 34 into a digital signal, a RAM 36 for temporarily storing the A/D converted signal and so on, a ROM 37 for storing control programs to execute processing procedures described later, a central processing unit, i.e., a CPU 38, for processing the operation signals in accordance with the control programs stored in the ROM 37, and output ports 39 for amplifying and outputting outputs of the CPU 38 to the control valves 10*a–f*, the flow control valves 15–20, 65–70 and the bypass valve 21.

Figure 5:
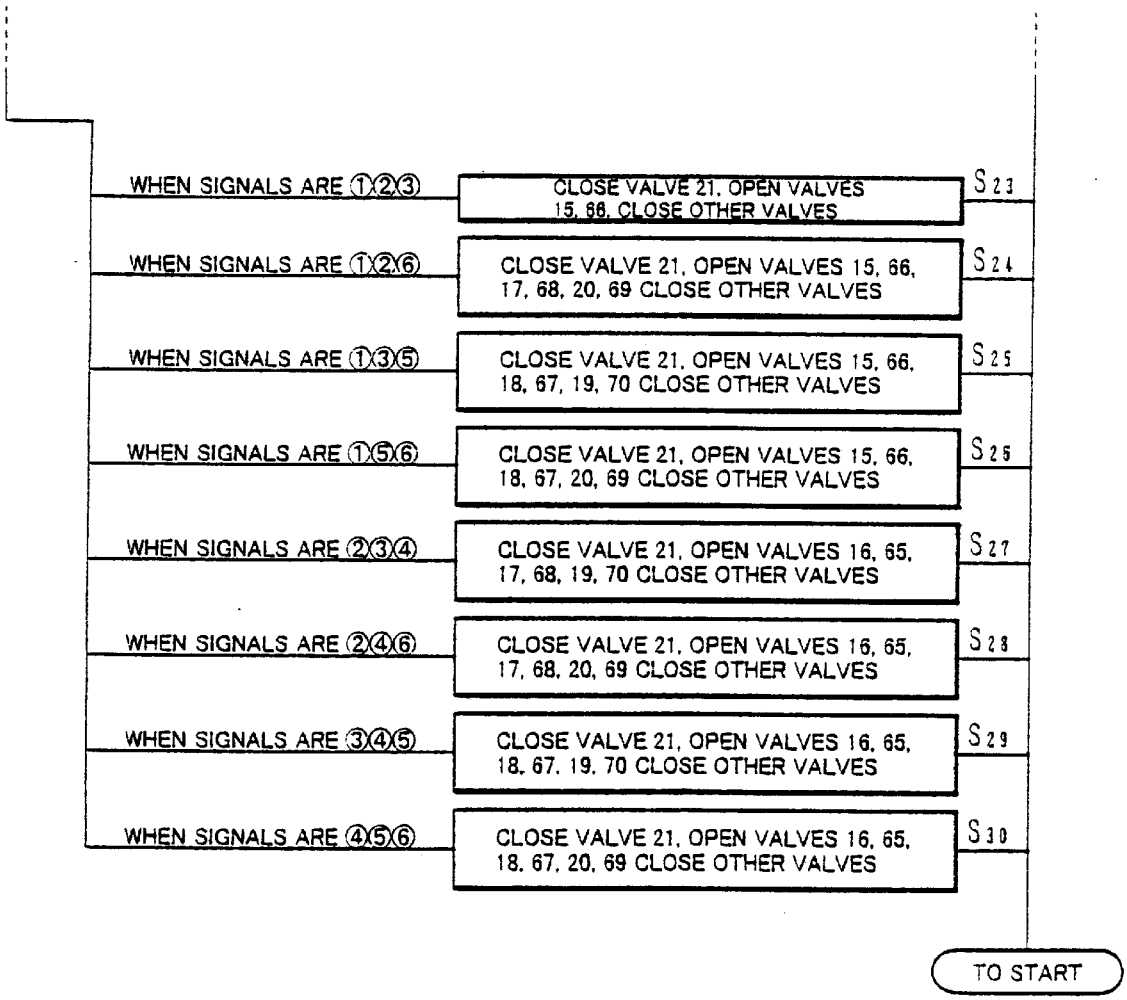
FIG. 5 is a flowchart showing control functions of the calculator shown in FIG. 1.

The ROM 37 stores not only general control programs for controlling the control valves 10*a*–10*f* in accordance with the operation signals from the control levers 32, 33, but also control programs for controlling the flow control valves 15–20, 65–70 and the bypass valve 21 following flowcharts, shown in FIGS. 4 and 5, in accordance with the present invention.

The operation of the hydraulic drive system thus constructed will now be described with reference to the flowcharts shown in FIGS. 4 and 5.

In the hydraulic excavator shown in FIG. 2, it is general that when the boom 75, the arm 76 and the bucket 77 constituting the front device 14 are operated in the direction to respectively perform the operations of boom-up, arm crowding and bucket crowding when the hydraulic cylinders 5*a*, 5*b*, 6, 7 are actuated to extend, demanded flow rates are increased and loads become large. For this reason, the calculator 131 executes processing of the operation signals output from the control levers 32, 33 for operating the front device 14 in different manners for the arm crowding operation signal, the bucket crowding operation signal and the boom-up operation signal from the other operation signals, i.e., between the operation signals instructing extension of the front hydraulic cylinders 5*a*, 5*b*, 6, 7 and the other operation signals.

Specifically, when the control levers 32, 33 are first in neutral positions, the flow control valves 15–20, 65–70 are all closed and the bypass valve 21 is opened, causing the hydraulic fluid from the pumps 3*a*, 3*b* to return to the reservoir 2 through the bypass valve 21. Then, when any of the control levers 32, 33 is operated in the above condition, it is determined whether the produced signal from the control lever is one of the boom-up operation signal (abbreviated as the operation signal (1) hereinafter), the arm crowding operation signal (abbreviated as the operation signal (2) hereinafter), the bucket crowding operation signal (abbreviated as the operation signal (3) hereinafter), or whether the produced operation signal is one of the boom-down operation signal (abbreviated as the operation signal (4) hereinafter), the arm dumping operation signal (abbreviated as the operation signal (5) hereinafter) and the bucket dumping operation signal (abbreviated as the operation signal (6) hereinafter) (step S1).

When the operation signal is one of the operation signals (1)(2)(3)(4)(5)(6), the processing is executed in a different way depending on which one of the operation signals (1)(2)(3)(4)(5)(6) it is.

More specifically, when the operation signal is (1), the bypass valve 21 is closed, the flow control valves 15, 16 are opened, and the other flow control valves 16–20, 65, 67–70 are closed (step S2). Thereby, the hydraulic fluid delivered from the third and fourth hydraulic pumps 3*a*, 3*b* is jointly supplied to the bottom sides of the boom hydraulic cylinders 5*a*, 5*b* in addition to the hydraulic fluid delivered from the first and second hydraulic pumps 1*a*, 1*b*, and the return hydraulic fluid from the rod sides of the boom hydraulic cylinders 5*a*, 5*b* is drained to the hydraulic reservoir 2 through not only the main line 115 and the control valves 10*c*, 10*d*, but also the branch line 151B and the drain line 101. As a result, the hydraulic cylinders 5*a*, 5*b* can be operated to extend at a higher speed or under a higher load.

Likewise, when the operation signal is (2) or (3), the bypass valve 21 is closed, the flow control valves 17, 68 or 19, 70 are opened, and the other flow control valves are closed (step S3, S4). Thereby, the hydraulic fluid delivered from the third and fourth hydraulic pumps 3*a*, 3*b* is jointly supplied to the bottom side of the arm hydraulic cylinder 6 or the bucket hydraulic cylinder 7, and the return hydraulic fluid from the rod side of the arm hydraulic cylinder 6 or the bucket hydraulic cylinder 7 is drained to the hydraulic reservoir 2 through not only the main line 106 or 117 and the control valves 10*b*, 10*e* or 10*a*, but also the branch line 151D or 151F and the drain line 101. As a result, the hydraulic cylinder 6 or 7 can be operated to extend at a higher speed or under a higher load.

Further, when the operation signal is (4), the bypass valve 21 is closed, the corresponding flow control valves 16, 65 are opened, and the other flow control valves are closed (step S5). Thereby, the hydraulic fluid delivered from the third and fourth hydraulic pumps 3*a*, 3*b* is jointly supplied to the rod sides of the boom hydraulic cylinders 5*a*, 5*b* in addition to the hydraulic fluid delivered from the first and second hydraulic pumps 1*a*, 1*b*, and the return hydraulic fluid from the bottom sides of the boom hydraulic cylinders 5*a*, 5*b* is drained to the hydraulic reservoir 2 through not only the control valves 10*c*, 10*d*, but also the drain line 101 and the reservoir line 103. As a result, the hydraulic cylinders 5*a*, 5*b* can be operated to contract at a higher speed.

Likewise, when the operation signal is (5) or (6), the bypass valve 21 is closed, the flow control valves 18, 67 or 20, 69 are opened, and the other flow control valves are closed (step S6, S7). Thereby, the hydraulic fluid delivered from the third and fourth hydraulic pumps 3*a*, 3*b* is jointly supplied to the rod side of the arm hydraulic cylinder 6 or the bucket hydraulic cylinder 7, and the return hydraulic fluid from the bottom side of the arm hydraulic cylinder 6 or the bucket hydraulic cylinder 7 is drained to the hydraulic reservoir 2 through not only the control valves 10*b*, 10*e* or 10*a*, but also the drain line 101 and the reservoir line 103. As a result, the hydraulic cylinder 6 or 7 can be operated to contract at a higher speed.

Next, when the operation of the control levers 32, 33 produces two or more of the operation signals (1)(2)(3)(4)(5)(6), it is determined whether those signals are two or not (step S8). If there are two, then the processing is executed in a different way depending on which one of combinations among the operation signals (1)(2)(3)(4)(5) (6) the two signals have.

More specifically, when the operation signals are (1)(2), it is first determined whether a difference between input amounts indicated by the operation signals (1)(2) is not less than a certain value (step S9). If the difference is less than the certain value, then the bypass valve 21 is closed, the flow control valves 15, 66 and 17, 68 are shifted under proportional control so that these valves have openings in proportion to the input amounts of the corresponding operation signals (1)(2), and the other flow control valves are closed (step S10). Thereby, the hydraulic fluid delivered from the third and fourth hydraulic pumps 3*a*, 3*b* is jointly supplied to the bottom sides of the boom hydraulic cylinders 5*a*, 5*b* and the arm hydraulic cylinder 6 at flow rates distributed depending on the ratio between the input amounts of the operation signals (1)(2), and the return hydraulic fluid from the rod sides of the boom hydraulic cylinders 5*a*, 5*b* and the arm hydraulic cylinder 6 is branched and drained at flow rates also distributed depending on the ratio between the input amounts of the operation signals (1)(2). Accordingly, the combined operation of boom-up and arm crowding can be performed in a manner adapted for the ratio between the input amounts indicated by the operation signals (1)(2), while utilizing the hydraulic fluid delivered from the third and fourth hydraulic pumps 3*a*, 3*b* as well.

If the difference between the input amounts of the operation signals (1)(2) is larger than the certain value and the operation signal (1) is larger than (2), then the bypass valve 21 is closed, the flow control valves 15, 66 are opened, and the other flow control valves are closed (step S11). Thereby, the hydraulic fluid delivered from the third and fourth hydraulic pumps 3*a*, 3*b* is jointly supplied to the bottom sides of the boom hydraulic cylinders 5*a*, 5*b* only, and the return hydraulic fluid from the rod sides of the boom hydraulic cylinders 5*a*, 5*b* only is branched and drained to the hydraulic reservoir 2. The reason for making such control is as follows.

Generally, one of various kinds of work carried out by the hydraulic excavator is excavating and scooping work in which, after excavating earth and sand, the bucket 77 is drawn toward the body side to scoop the dug earth and sand in the bucket 77. On this occasion, the bucket 77 is drawn toward the body side by raising the boom 75 and crowding the arm 76. At this time, however, the load pressure for the boom-up operation is extremely large, whereas the load pressure for the arm crowding operation is relatively small. To avoid that the hydraulic fluid delivered from the hydraulic pumps is supplied to only the arm hydraulic cylinder under a light load and the boom-up operation is disabled, therefore, the operator usually manipulates the boom control lever in a maximum input amount and the arm control lever in a very small input amount. In that combined operation, it is desired to supply the hydraulic fluid to the boom hydraulic cylinders 5*a*, 5*b* as much as possible for quickly drawing the bucket 77. Accordingly, if the difference between the input amounts of the operation signals (1)(2) is larger than the certain value and the operation signal (1) is larger than (2), then it is judged that the above combined operation is going to be performed, whereupon the hydraulic fluid delivered from the third and fourth hydraulic pumps 3*a*, 3*b* is supplied to the bottom sides of the boom hydraulic cylinders 5*a*, 5*b* only, as stated above. As a result, the boom-up operation is quickly performed so that, in the excavating and scooping work, the bucket is drawn toward the body side in a shorter time and the working efficiency is improved.

Also, when the operation signals are (1)(3) or (2)(3), the bypass valve 21 is closed, the flow control valves 15, 19, 66, 70 or 17, 19, 68, 70 are shifted under proportional control so that these valves have openings in proportion to the input amounts of the corresponding operation signals (1)(3) or (2)(3), and the other flow control valves are closed (step S12 or S13). Thereby, the hydraulic fluid delivered from the third and fourth hydraulic pumps 3 is jointly supplied to the bottom sides of the boom hydraulic cylinders 5 and the bucket hydraulic cylinder 7 or the arm hydraulic cylinder 6 and the bucket hydraulic cylinder 7 at flow rates distributed depending on the ratio between the input amounts of the operation signals (1)(3) or (2)(3), and the return hydraulic fluid from the rod sides of the boom hydraulic cylinders 5 and the bucket hydraulic cylinder 7 or the arm hydraulic cylinder 6 and the bucket hydraulic cylinder 7 is branched and drained at flow rates also distributed depending on the ratio between the input amounts of the operation signals (1)(3) or (2)(3). Accordingly, the combined operation of boom-up and bucket crowding or arm crowding and bucket crowding can be performed in a manner adapted for the ratio between the input amounts indicated by the operation signals (1)(3) or (2)(3), while utilizing the hydraulic fluid delivered from the third and fourth hydraulic pumps 3*a*, 3*b* as well.

The combined operation instructed by the operation signals (2)(3), particularly, intends to perform excavating by a combination of arm crowding and bucket crowding. It is desired in such excavating work that the bucket crowding be surely performed regardless of load fluctuations. With this embodiment, when the load pressure of the bucket hydraulic cylinder 7 is smaller than the load pressure of the arm hydraulic cylinder 6, the hydraulic fluid delivered from the third and fourth hydraulic pumps 3*a*, 3*b* is also supplied to the bucket hydraulic cylinder 7 in a proportionally distributed manner, enabling the excavating work to be performed at a higher speed. Further, even when the load pressure of the bucket hydraulic cylinder 7 is large, the hydraulic fluid from the third and fourth hydraulic pumps 3*a*, 3*b* is surely supplied to the bucket hydraulic cylinder 7, and a trouble that the bucket hydraulic cylinder 7 would fail to move can be therefore avoided.

When the operation signals are (1)(5) or (1)(6), the bypass valve 21 is closed, the flow control valves 15, 18, 66, 67 or 15, 20, 66, 69 are opened, and the other flow control valves are closed (step S14, S15). Thereby, the hydraulic fluid delivered from the third and fourth hydraulic pumps 3*a*, 3*b* is jointly supplied to the bottom sides of the boom hydraulic cylinders 5*a*, 5*b*, and the return hydraulic fluid from the rod sides of the boom hydraulic cylinders 5*a*, 5*b* is branched and drained to the hydraulic reservoir 2. Further, the hydraulic fluid delivered from the third and fourth hydraulic pumps 3*a*, 3*b* is jointly supplied to the rod side of the arm hydraulic cylinder 6 or the bucket hydraulic cylinder 7, and the return hydraulic fluid from the bottom side of the arm hydraulic cylinder 6 or the bucket hydraulic cylinder 7 is drained to the hydraulic reservoir 2 through not only the control valves 10*b*, 10*e* or 10*a*, but also the drain line 101 and the reservoir line 103. Accordingly, the combined operation of boom-up and arm dumping or bucket dumping can be performed at a high speed with a less pressure loss and high efficiency.

Likewise, when the operation signals are (2)(4) or (2)(6), the bypass valve 21 is closed, the flow control valves 16, 17, 65, 68 or 17, 20, 68, 69 are opened, and the other flow control valves are closed (step S16, S17). When the operation signals are (3)(4) or (3)(5), the bypass valve 21 is closed, the flow control valves 16, 19, 65, 70 or 18, 19, 67, 70 are opened, and the other flow control valves are closed (step S18, S19). Thereby, the hydraulic fluid delivered from the third and fourth hydraulic pumps 3*a*, 3*b* is jointly supplied to the bottom or rod sides of the corresponding hydraulic cylinders, and the return hydraulic fluid from the rod or bottom sides of the hydraulic cylinders is drained to the hydraulic reservoir 2 through not only the corresponding control valves 10, but also the drain line 101 and the reservoir line 103. As a result, the intended combined operation can be performed at a high speed with a less pressure loss and high efficiency.

Also, when the operation signals are (4)(5) or (4)(6), the bypass valve 21 is closed, the flow control valves 16, 18, 65, 67 or 16, 20, 65, 69 are shifted under proportional control so that these valves have openings in proportion to the input amounts of the corresponding operation signals (4)(5) or (4)(6), and the other flow control valves are closed (step S20, S21). Thereby, the hydraulic fluid delivered from the third and fourth hydraulic pumps 3*a*, 3*b* is jointly supplied to the rod sides of the boom hydraulic cylinders 5*a*, 5*b* and the arm hydraulic cylinder 6 or the bucket hydraulic cylinder 7 at flow rates distributed depending on the ratio between the input amounts of the operation signals (4)(5) or (4)(6). Further, the return hydraulic fluid from the bottom sides of the boom hydraulic cylinders 5*a*, 5*b* and the arm hydraulic cylinder 6 and the bucket hydraulic cylinder 7 is drained to the hydraulic reservoir 2 through not only the control valves 10*c*, 10*d* and 10*b*, 10*e* or 10*a*, but also the drain line 101 and the reservoir line 103 at flow rates also distributed depending on the ratio between the input amounts of the operation signals (4)(5) or (4)(6). Accordingly, the combined operation of boom-down and arm dumping or bucket dumping can be performed at a higher speed with a less pressure loss and high efficiency.

Likewise, when the operation signals are (5)(6), the bypass valve 21 is closed, the flow control valves 18, 20, 67, 69 are shifted under proportional control so that these valves have openings in proportion to the input amounts of the corresponding operation signals (5)(6), and the other flow control valves are closed (step S22). Thereby, the hydraulic fluid delivered from the third and fourth hydraulic pumps 3*a*, 3*b* is jointly supplied to the rod sides of the arm hydraulic cylinder 6 and the bucket hydraulic cylinder 7 at flow rates distributed depending on the ratio between the input amounts of the operation signals (5)(6). Further, the return hydraulic fluid from the bottom sides of the arm hydraulic cylinder 6 and the bucket hydraulic cylinder 7 is drained to the hydraulic reservoir 2 through not only the control valves 10*b*, 10*e* and 10*a*, but also the drain line 101 and the reservoir line 103 at flow rates also distributed depending on the ratio between the input amounts of (5)(6). Accordingly, the combined operation of arm dumping and bucket dumping can be performed at a higher speed with a less pressure loss and high efficiency.

When the operation of the control levers 32, 33 produces three of the operation signals (1)(2)(3)(4) (5)(6), the processing is executed in a different way depending on which one of combinations among the operation signals (1)(2)(3) (4)(5)(6) the three signals have.

More specifically, when the operation signals are (1)(2) (3), the bypass valve 21 is closed, the flow control valves 15, 66 are opened, and the other flow control valves are closed (step S23).

The combined operation instructed by the operation signals (1)(2)(3) includes horizontal drawing work in which the ground surface after excavating is leveled by crowding both the arm 76 and the bucket 77 while raising the boom 75. In such horizontal drawing work, the load pressures of the boom hydraulic cylinders 5*a*, 5*b* are much larger than the load pressures of the arm and bucket hydraulic cylinders 6, 7. For this reason, the hydraulic fluid delivered from the third and fourth hydraulic pumps 3*a*, 3*b* is exclusively supplied to the bottom sides of the boom hydraulic cylinders 5*a*, 5*b*, as mentioned above, so that the hydraulic fluid can be surely supplied to the boom hydraulic cylinders 5*a*, 5*b* subjected to a large load and the horizontal drawing work can be smoothly performed.

Also, when the operation signals are (1)(2)(6), the bypass valve 21 is closed, the flow control valves 15, 17, 20, 66, 68, 69 are opened, and the other flow control valves are closed (step S24). Thereby, the hydraulic fluid delivered from the third and fourth hydraulic pumps 3*a*, 3*b* is jointly supplied to the bottom sides of the boom hydraulic cylinders 5*a*, 5*b* and the arm hydraulic cylinder 6, and the return hydraulic fluid from the rod sides of the boom hydraulic cylinders 5*a*, 5*b* and the arm hydraulic cylinder 6 is branched and drained to the hydraulic reservoir 2 through the main lines 115, 106 and through the branch lines 151B, 151D and the drain line 101. Further, the hydraulic fluid delivered from the third and fourth hydraulic pumps 3*a*, 3*b* is jointly supplied to the rod side of the bucket hydraulic cylinder 7, and the return hydraulic fluid from the bottom side of the bucket hydraulic cylinder 7 is drained to the hydraulic reservoir 2 through not only the control valve 10*a*, but also the drain line 101 and the reservoir line 103. Accordingly, the combined operation of boom-up, arm crowding and bucket dumping can be performed at a high speed with a less pressure loss and high efficiency.

Likewise, when the operation signals are (1)(3)(5), the bypass valve 21 is closed, the flow control valves 15, 18, 19, 66, 67, 70 are opened, and the other flow control valves are closed (step S25). When the operation signals are (1)(5)(6), the bypass valve 21 is closed, the flow control valves 15, 18, 20, 66, 67, 69 are opened, and the other flow control valves are closed (step S26). When the operation signals are (2)(3)(4), the bypass valve 21 is closed, the flow control valves 16, 17, 19, 65, 68, 70 are opened, and the other flow control valves are closed (step S27). When the operation signals are (2)(4)(6),.the bypass valve 21 is closed, the flow control valves 16, 17, 20, 65, 68, 69 are opened, and the other flow control valves are closed (step S28). When the operation signals are (3)(4)(5), the bypass valve 21 is closed, the flow control valves 16, 18, 19, 65, 67, 70 are opened, and the other flow control valves are closed (step S29). When the operation signals are (4)(5)(6), the bypass valve 21 is closed, the flow control valves 16, 18, 20, 65, 67, 69 are opened, and the other flow control valves are closed (step S30).

Thus, the hydraulic fluid is supplied to the bottom (or rod) sides of the corresponding hydraulic cylinders through not only the control valves, but also the supply line 100 and corresponding ones of the branch lines 150A–E. Also, the return hydraulic fluid from the rod (or bottom) sides of the corresponding hydraulic cylinders is drained to the hydraulic reservoir 2 through not only the control valves, but also the drain line 101 and the reservoir line 103. Consequently, the combined operation intended by the operator can be performed at a high speed with a less pressure loss and high efficiency.

Figure 6:
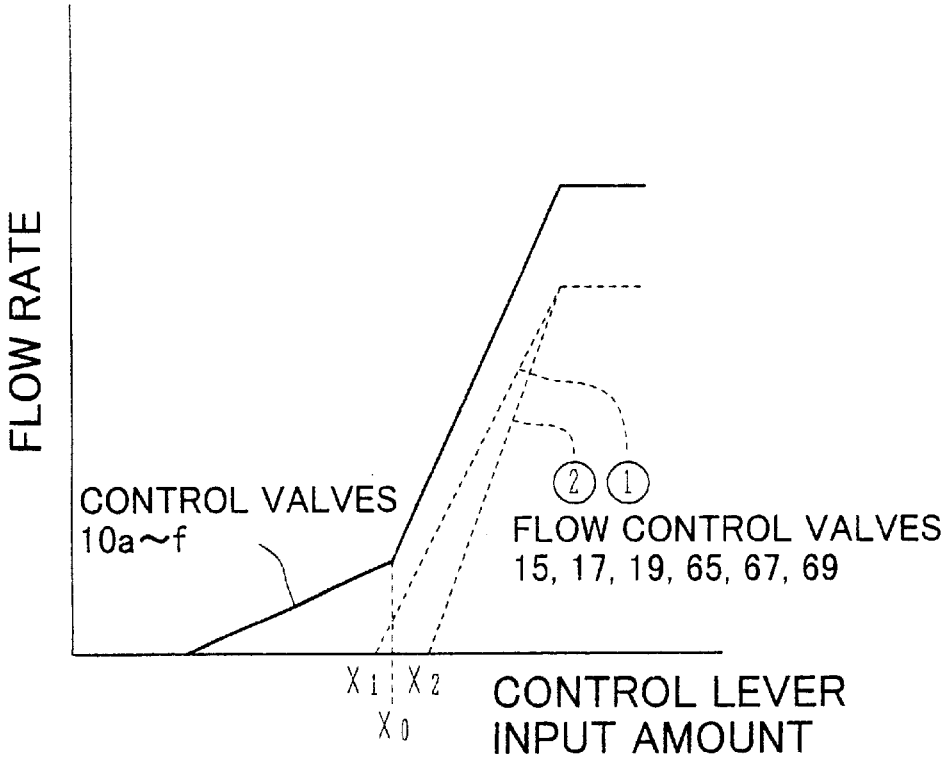
FIG. 6 is a graph showing one example of a control lever input amount versus flow rate characteristic.

In the process of carrying out the various combined operations stated above, the calculator 131 performs a function of control means for controlling the control valves 10*a–f* and the flow control valves 15, 17, 19, 65, 67, 69 to be driven in correlated manners explained below in accordance with the general control programs which are stored in the ROM 37 (see FIG. 3) and control the control valves 10*a*–10*f* in response to the operation signals from the control levers 32, 33. FIG. 6 shows one example of details of control executed by the calculator 131, and represents flow rate characteristics (solid lines) of the control valves 10*a–f* and flow rate characteristics (broken lines (1) or (2)) of the flow control valves 15, 17, 19, 65, 67, 69 with respect to the control lever input amount. As seen from FIG. 6, first, in an area (first input amount area) where the input amounts of the control levers 32, 33 are relatively small, only the control valves 10*a–f* are moved over strokes at a relatively small ratio with respect to an increase of the input amount, thereby supplying the hydraulic fluid to the corresponding main lines 105–107, 115–117. Then, in an area (second input amount area) where the input amounts of the control levers 32, 33 are relatively large, i.e., after a position at which the flow rate through any of the control valves 10*a–f* starts to rise quickly with an increase of the lever input amount, the control valves 10*a–f* are moved over strokes at a relatively large ratio with respect to an increase of the input amount, thereby supplying the hydraulic fluid to the corresponding main lines 105–107, 115–117. At this time, the flow control valves 15, 17, 19, 65, 67, 69 are also moved over strokes substantially at the same ratio as for the control valves 10*a–f* with respect to an increase of the input amount. On the characteristic curves of control lever input amount versus flow rate shown in FIG. 6, positions (input amounts x1, x2) at which the flow control valves 15, 17, 19, 65, 67, 69 start to supply the hydraulic fluid correspond to a position xo at which the characteristic curve of the control valves 10*a–f* starts to rise quickly (including the vicinity of the rising-start position). Upon the movement of the flow control valves, the hydraulic fluid is supplied to the corresponding main lines 105–107, 115–117 through the corresponding branch lines 150A–F. Accordingly, just before or after the hydraulic fluid through the control valves 10*a–f* is sufficiently supplied to the corresponding main lines 105, 116, 107 or 115, 106, 117, the hydraulic fluid through the corresponding flow control valves 15, 17, 19 or 65, 57, 69 starts to be supplied to the main lines 105, 116, 107 or 115, 106, 117 from the branch lines 150A, C, E or 150B, D, F. As a result, at the time the flow control valves 15, 17, 19 or 65, 57, 69 are switched over, it is possible to prevent the actuators from speeding up so abruptly as to cause shocks, or make the operator feel less awkward in operation.

In this embodiment, as explained above, the various combined operations can be performed at a high speed with a less pressure loss and high efficiency by controlling the flow control valves 15–20, 65–70 and the bypass valve 21 to be selectively opened and closed. Additionally, the greatest feature of this embodiment is to reduce the total length of the lines, such as hoses or steel pipes, in a supersized excavator, and to lessen the entire pressure loss of a hydraulic circuit thereof. This main advantage will be described below in detail.

In the hydraulic drive system of this embodiment, when the hydraulic cylinders are operated in the direction to extend, the hydraulic fluid delivered from the hydraulic pumps 1*a*, 1*b* is supplied to the corresponding main lines 105, 116, 107 through the control valve group 10. At this time, the hydraulic fluid delivered from the hydraulic pumps 3*a*, 3*b* is also supplied to the main lines 105, 116, 107 through the delivery line 102, the supply line 100 and the branch lines 150A, C, E at flow rates adjusted by the bypass valve 21 and the flow control valves 15, 17, 19 in the branch lines 150A, C, E, without passing the control valve group 10. The hydraulic fluid supplied to the main lines 105, 116, 107 is then introduced to the bottom sides of the corresponding hydraulic cylinders 5*a*, 5*b*, 6, 7 to drive them, thereby operating the front members 75, 76, 77. On the other hand, the return hydraulic fluid from the rod sides of the hydraulic cylinders 5*a*, 5*b*, 6, 7 is simultaneously drained to the hydraulic reservoir 2 from the main lines 115, 106, 117 through the control valve group 10, and in addition also drained to the hydraulic reservoir 2 through the branch lines 151B, D, F and the drain line 101 at flow rates adjusted by the flow control valves 66, 68, 70 in the branch lines 151B, D, F, without passing the control valve group 10.

Next, when the hydraulic cylinders are operated in the direction to contract, for example, the hydraulic fluid delivered from the hydraulic pumps 1*a*, 1*b* is supplied to the corresponding main lines 115, 106, 117 through the control valve group 10. At this time, the hydraulic fluid delivered from the hydraulic pumps 3*a*, 3*b* is also supplied to the main lines 115, 106, 117 through the delivery line 102, the supply line 100 and the branch lines 150B, D, F at flow rates adjusted by the bypass valve 21 and the flow control valves 65, 67, 69 in the branch lines 150B, D, F, without passing the control valve group 10. The hydraulic fluid supplied to the main lines 115, 106, 117 is then introduced to the rod sides of the corresponding hydraulic cylinders 5*a*, 5*b*, 6, 7 to drive them, thereby operating the front members 75, 76, 77. On the other hand, part of the return hydraulic fluid from the bottom sides of the hydraulic cylinders 5*a*, 5*b*, 6, 7 is simultaneously drained to the hydraulic reservoir 2 from the main lines 105, 116, 107 through the control valve group 10. In addition, the remaining return hydraulic fluid is drained to the hydraulic reservoir 2 through the main lines 105, 116, 107, the branch lines 151A, C, E, the drain line 101 and the reservoir line 103 at flow rates adjusted by the flow control valves 16, 18, 20 disposed in the branch lines 151A, C, E. By thus employing two return routes, the hydraulic cylinders 5*a*, 5*b*, 6, 7 can be driven in the direction to contract for operating the front members 75, 76, 77, while draining the return hydraulic fluid at a super-large flow rate from the bottom sides of the hydraulic cylinders 5*a*, 5*b*, 6, 7.

Here, the conventional structure can also be employed as a measure for realizing a super-high flow rate in the super-sized excavator intended by this embodiment. In other words, the super-high flow rate can be realized by simply adding the hydraulic pumps 3*a*, 3*b*, the control valve group 11 and the main lines 125–127, 135–137 such that the downstream ends of the main lines 125–127, 135–137 are connected to the originally existing main lines 105–107, 115–117, as shown FIG. 9 before. In such a case, however, a large number of high-pressure lines would have to be routed along the front device 14 from the body side to the respective cylinders. Specifically, in an area (conceptually indicated by D in FIG. 9) of the front device 14 nearer to the body side than the boom cylinders 5*a*, 5*b*, there are routed a total of twelve lines; i.e., the four main lines 105, 125, 115, 135 to the bottom and rod sides of the boom cylinders 5*a*, 5*b*, the four main lines 116, 136, 106, 126 to the bottom and rod sides of the arm cylinder 6, and the four main lines 107, 127, 117, 137 to the bottom and rod sides of the bucket cylinder 7. In an area (conceptually indicated by E in FIG. 9) of the front device 14 farther from the body side than the boom cylinders 5*a*, 5*b* but nearer to the body side than the arm cylinder 6, there are routed a total of eight lines; i.e., the four main lines 116, 136, 106, 126 to the bottom and rod sides of the arm cylinder 6 and the four main lines 107, 127, 117, 137 to the bottom and rod sides of the bucket cylinder 7. In an area (conceptually indicated by F in FIG. 9) of the front device 14 farther from the body side than the arm cylinder 6 but nearer to the body side than the bucket cylinder 7, there are routed the four main lines 107, 127, 117, 137 to the bottom and rod sides of the bucket cylinder 7.

In the hydraulic drive system of this embodiment, of the present invention by contrast, the hydraulic pumps 1*a*, 1*b* and 3*a*, 3*b*, the control valves 10*a*–*f*, the delivery line 102, the reservoir line 103 and the bypass valve 21 are installed on the body 13 of the hydraulic excavator, whereas the main lines 105, 115, 116, 106, 107, 117, the supply line 100, the drain line 101, the branch lines 150A–F and 151A–F, the flow control valves 15–20 and 65–70, and the hydraulic cylinders 5*a*, 5*b*, 6, 7 are installed on the front device 14. In addition, the positions where the branch lines 150A–F or 151A–F are branched from the supply line 100 or the drain line 101 are located near the corresponding hydraulic cylinders. The number of high-pressure lines led to the bottom and rod sides of the respective hydraulic cylinders, which are particularly problematic from the viewpoint of pressure loss, is therefore reduced in most areas of the front device 14 as compared with the system of FIG. 9 employing the conventional structure.

To explain it in more detail, besides the drain line 101 as a low-pressure line, the number of high-pressure lines is reduced as follows. In an area (conceptually indicated by A in FIG. 1) of the front device 14 nearer to the body side than the vicinity of the boom cylinders 5*a*, 5*b*, a total of only seven lines are required to be routed; i.e., the two main lines 105, 115 to the bottom and rod sides of the boom cylinders 5*a*, 5*b*, the two main lines 116, 106 to the bottom and rod sides of the arm cylinder 6, the two main lines 107, 117 to the bottom and rod sides of the bucket cylinder 7, and the one supply line 100. In an area (conceptually indicated by B in FIG. 1) of the front device 14 farther from the body side than the vicinity of the boom cylinders 5*a*, 5*b* but nearer to the body side than the vicinity of the arm cylinder 6, a total of only five lines are required to be routed i.e., the two main lines 116, 106 to the bottom and rod sides of the arm cylinder 6, the two main lines 107, 117 to the bottom and rod sides of the bucket cylinder 7, and the one supply line 100. In an area (conceptually indicated by C in FIG. 1) of the front device 14 farther from the body side than the vicinity of the arm cylinder 6 but nearer to the body side than the vicinity of the bucket cylinder 7, a total of only three lines are required to be routed; i.e., the two main lines 107, 117 to the bottom and rod sides of the bucket cylinder 7 and the one supply line 100.

Thus, in the areas indicated by D, E, F in FIG. 9 and A, B, C in FIG. 1, the hydraulic drive system of this embodiment of the present invention can reduce the number of high-pressure lines on each of the bottom and rod sides as compared with the case of employing the conventional structure. The total length of hoses, steel pipes or the likes constituting the high-pressure lines can therefore be shortened.

As explained above, this embodiment can reduce the number of high-pressure lines as compared with the case of employing the conventional structure, and the total length of hoses, steel pipes or the likes can be shortened correspondingly as a whole of the hydraulic excavator. Accordingly, a pressure loss in the entirety of the hydraulic circuit can be reduced, thus making it possible to lessen the energy loss, increase the operating speeds of the hydraulic cylinders, and improve the working efficiency. Further, by increasing the diameter of a hose, a steel pipe or the like as far as possible which constitutes the drain line 101 as a low-pressure line, the pressure loss can be further reduced.

Comparing FIG. 9 employing the conventional structure and FIG. 1 of this embodiment from the standpoint of valves, the control valves 11*a–f* in FIG. 9 are replaced by the flow control valves 15–20, 65–70 and the bypass valve 21. The flow control valves 15–20, 65–70 and the bypass valve 21 which are individual valves are generally easier to be adapted for an increase in capacity than the control valves 11 in FIG. 9. This also contributes to reducing the pressure loss remarkably.

Also, with this embodiment, when the control levers 32, 33 are in the neutral positions, the flow control valves 15–20, 65–70 are all closed and the bypass valve 21 is opened, causing the hydraulic fluid from the pumps 3*a*, 3*b* to return to the reservoir 2 through the bypass valve 21. Accordingly, the bypass valve 21 is disposed midway of the shortest distance between the pumps 3*a*, 3*b* and the hydraulic reservoir 2. This provides another advantage that the loss caused in the neutral condition of the control levers 32, 33 can be minimized to a lower level than caused in the case of FIG. 9 employing the conventional structure.

While the above embodiment includes the branch lines 150B, D, F and 151B, D, F having one sides connected to the main lines 115, 106, 117 which are in turn connected to the rod sides of the hydraulic cylinders 5*a*, 5*b*, 6, 7, and the flow control valves 65, 66, 67, 68, 69, 70 provided respectively in those branch lines, the above branch lines and flow control valves are not necessarily provided. In general, because a hydraulic cylinder has a capacity difference of about twice between the bottom side and the rod side, the rod side does not often require as large a flow rate as required on the bottom side even in a supersized excavator in which a super-high flow rate is to be achieved. In such a case, the hydraulic circuit on the rod side may be arranged such that the hydraulic fluid is supplied and returned trough the control valve group 10 as per conventional. Alternatively, the hydraulic fluid from the third and fourth hydraulic pumps may be joined with the rod sides of only desired ones of the hydraulic cylinders. Further, only the branch lines 151B, 151D, 151F and the flow control valves 66, 68, 70 corresponding to those branch lines may be disposed on the rod sides of the hydraulic cylinders so that when the hydraulic cylinders are operated to extend, the return hydraulic fluid from the rod sides are returned to the reservoir through the control valves 10 and the drain line 101 for reducing the pressure loss of the return hydraulic fluid. Other various combinations are also conceivable.

In the above embodiment, the hydraulic fluid for the swing hydraulic motor 8 is supplied and returned through the control valve 10*f* as per conventional, but the present invention is not limited to such an arrangement. As with the other hydraulic cylinders 5*a*, 5*b*, 6, 7, the hydraulic fluid to the swing hydraulic motor 8 may also be jointly supplied through the supply line 100, and/or the return hydraulic fluid therefrom may also be jointly drained through the drain line 101. This modified case can also provide the similar advantages as mentioned above.

While the above embodiment is designed to shift the flow control valves under proportional control depending on the input amounts only in steps S10, S12, S13, S20, S21, S22 in FIG. 4 when there are two or three operation signals, the present invention is not limited to such an arrangement. It is apparent that, in any of the other combined operations (steps S11, S14–S19, S23–S30), the flow control valves may also be shifted under proportional control depending on the kinds of work and so on, if desired, without departing from the gist of the present invention. On the contrary, in any of steps S10, S12, S13, S20, S21, S22 which have been explained above as performing proportional control, the flow control valves may also be shifted under not proportional control, but normal on/off control if the proportional control is not particularly required in consideration of the kinds of work and so on.

While the above embodiment is designed to determine a difference between the input amounts in S9 for only the combination of the signals (1)(2) and to perform different control manners between S10 and S11 depending on the difference when there are two or three operation signals in FIG. 4, the present invention is not limited to such an arrangement. For example, the processing may also be executed for the combination of the signals (1)(5) (step S14) by determining a difference of the input amounts and opening only the flow control valves 15, 66 for the boom hydraulic cylinders 5*a*, 5*b* when the difference is not less than a certain value. In this case, the following meaning is resulted.

Generally, one of various kinds of work carried out by a hydraulic excavator is dump loading work for loading dug earth and sand on a dump truck. In such work, the arm 76 is dumped while swinging the swing base and raising the boom 75. At this time, the load pressure for the boom-up operation is extremely large, whereas the load pressure for the arm dumping operation is relatively small. To avoid that the hydraulic fluid delivered from the hydraulic pumps is supplied to only the arm hydraulic cylinder under a light load and the boom-up operation is disabled, therefore, the operator usually manipulates the boom control lever in a maximum input amount and the arm control lever in a very small input amount. In that combined operation, it is desired to supply the hydraulic fluid to the boom hydraulic cylinders 5*a*, 5*b* as much as possible for quickly raising the bucket 77. Accordingly, as with step S9, if the difference between the input amounts of the operation signals (1)(5) is larger than the certain value and the operation signal (1) is larger than (5), then it is judged that the above combined operation is going to be performed, whereupon the hydraulic fluid delivered from the third and fourth hydraulic pumps 3*a*, 3*b* is supplied to the bottom sides of the boom hydraulic cylinders 5*a*, 5*b* only. As a result, the boom-up operation is quickly performed so that, in the dump loading work, the bucket can be raised in a shorter time. Corresponding to the above case, it is also possible to modify the control process such that only the flow control valves 15, 66 for the boom hydraulic cylinders 5*a*, 5*b* are opened in S24 where the three operations signals (1)(3)(5) are produced.

While the above embodiment uses solenoid proportional valves with pressure compensating functions as the flow control valves 15–20, 65–70 and the bypass valve 21, the present invention is not limited to such an arrangement. The use of solenoid proportional valves with pressure compensating functions is preferable from the standpoint of ensuring good operability because the hydraulic fluid can be always distributed at predetermined flow rates regardless of fluctuations in load of the hydraulic cylinders. But if the hydraulic fluid can be distributed to the hydraulic cylinders at desired flow rates without using pressure compensating functions in the intended work, solenoid proportional valves with no pressure compensating functions may be used case by case. Further, while the above embodiment uses, as the flow control valves 15–20, 65–70 and the bypass valve 21, solenoid proportional valves having openings varied in proportion to command signals, the solenoid proportional valves may be simple solenoid on/off valves. In this case, the operation of the solenoid valves under proportional control (see S10, S12, S13, S20, S21, S22 in FIG. 4) is not achieved in the above-explained embodiment, but the advantage of reducing the pressure loss caused by hoses, steel pipes or the likes which constitute the lines, as compared with the hydraulic driving system employing the conventional structure can also be provided through the simple on/off operation. Further, switching valves of the hydraulic pilot operated type may be used instead of the solenoid valves. In this case, although there may occur a lag in switching time among the control valves 10*a–f*, switching valves 15–20, 65–70 and the bypass valve 21, a necessary response level can be achieved by increasing the diameter of pilot lines or raising the value of a pilot pressure.

While the above embodiment has been explained as constituting each of the main lines 105–107, 115–117, the branch lines 150A–F and the supply line 100 by two or three hoses (or steel pipes, etc.), it is apparent that those lines may be each formed of one hose (or steel pipe, etc.) if there are no restrictions, mentioned above, upon the diameter of high-pressure hoses available in the market.

Moreover, the flow control valves 15–20, 65–70 may be constructed of seat valves which generate a smaller pressure loss than the control valves 10. An example of the construction in such a case will be described below with reference to FIGS. 7 and 8. FIG. 7 is a detailed view showing one 16 of the above flow control valves, by way of example, extracted from FIG. 1, and FIG. 8 is a view showing the structure of a seat valve corresponding to the construction of FIG. 7. Since the pressure compensating functions are not necessarily required in the flow control valves 15–20, 65–70 as stated above, the following description will be made of an example of the case having no pressure compensating functions.

In FIG. 8, a seat valve 203 fitted to a casing 202 includes a seat portion 203A for communicating/cutting off between an inlet line 221 communicating with the main line 105 and an outlet line 231 connected to the branch portion 151A through a check valve, an end surface 203C for bearing the pressure in the outlet line 231, an end surface 203B positioned on the opposite side to the end surface 203C for bearing the pressure in a back pressure chamber 204 formed between itself and the casing 202, and a throttle slit 203D for communicating between the inlet line 221 and the back pressure chamber 204. Also, a pilot line 205 for communicating the back pressure chamber 204 and the outlet line 231 is formed in the casing 202, and a variable throttle portion 206 constructed of a proportional solenoid valve and adjusting a flow rate through the pilot line 205 in response to a command signal 201 is disposed midway the pilot line 205.

In the above construction, the pressure in the inlet line 221 is introduced to the back pressure chamber 204 through the throttle slit 203D, and the seat valve 203 is pressed downward in the drawing by the introduced pressure so that the seat portion 203A cuts off between the inlet line 221 and the outlet line 231. When the desired command signal 201 is applied to open the variable throttle portion 206, the fluid in the inlet line 221 flows out to the outlet line 231 through the throttle slit 203D, the back pressure chamber 204, the variable throttle portion 206 and the pilot line 205. This flow lowers the pressure in the back pressure chamber 204 as a result of the throttling effect produced by the throttle slit 203D and the variable throttle portion 206. Accordingly, the force acting upon the end surface 203A, the end surface 203C and an end surface 203E becomes greater than the force acting upon the end surface 203B, whereupon the seat valve 203 is moved upward in the drawing, causing the fluid in the inlet line 221 to flows out directly to the outlet line 231. At this time, if the seat valve 203 is excessively raised, the throttling opening of the throttle slit 203D is increased to raise the pressure in the back pressure chamber 204, thereby moving the seat valve 203 downward in the drawing.

In this way, since the seat valve 203 is stopped at an appropriate position where the throttling degree of the throttle slit 203D is increased corresponding to the throttling degree of the variable throttle portion 206, a desired flow rate of the fluid passing from the inlet line 221 to the outlet line 231 can be controlled in accordance with the command signal 201.

Note that the above embodiment has been explained as applying the present invention to a hydraulic excavator of the backhoe type, but the present invention is also applicable a variety of construction machines including swing bases and front devices other than the backhoe type.

According to the present invention, the number of supply/return lines is reduced in most areas of the front device as compared with the case of employing the conventional structure. Correspondingly, the total length of hoses, steel pipes or the likes can be shortened as a whole of the hydraulic excavator and a pressure loss in the entirely of the hydraulic circuit can be reduced. It is therefore possible to lessen the energy loss, increase the operating speeds of the hydraulic cylinders, and improve the working efficiency. Also, when all the first flow control means are in the neutral positions, the hydraulic fluid from the other hydraulic pump is all returned to the hydraulic reservoir through the third flow control means. This arrangement allows the third flow control means to be disposed midway of the shortest distance between the other pump and the hydraulic reservoir. The loss caused in the neutral condition can therefore be minimized to a lower level than caused in the case employing the conventional structure.

What is claimed is:

1. A hydraulic drive system for hydraulic excavators equipped on a hydraulic excavator comprising an excavator body and a front device made up of a plurality of front members coupled to said body to be rotatable in the vertical direction, said front member including a boom, an arm and a bucket, said hydraulic drive system comprising a hydraulic reservoir provided on said body, at least one hydraulic pump, a plurality of hydraulic cylinders, including a boom cylinder, an arm cylinder, and a bucket cylinder for respectively driving said boom, arm and bucket, a plurality of pressure-uncompensated-type flow control valves provided on said body for respectively introducing a hydraulic fluid delivered from said hydraulic pump to said plurality of hydraulic cylinders by a flow rate variable according to a load pressure and controlling operation of the corresponding hydraulic cylinders, and a plurality of first connecting lines provided on said front device for respectively connecting said flow control valves and ones of the bottom and rod sides of the corresponding hydraulic cylinders, wherein:

said hydraulic drive system further comprises at least one other hydraulic pump provided on said working machine body separately from said hydraulic pump, a delivery line to which is introduced a hydraulic fluid delivered from said other hydraulic pump and a reservoir line for introducing the hydraulic fluid to said hydraulic reservoir, said delivery line and said reservoir line being both provided on said body, a second connecting line provided on said front device and connected at one side thereof to said delivery line and extended so that the other side end portion thereof is positioned at least near said bucket cylinder and at least a part thereof is shared in common as to a supply of a hydraulic fluid to said boom cylinder, arm cylinder, and bucket cylinder, a plurality of first lines provided on said front device for forming another hydraulic fluid supplying route not passing said flow control valves and each having one side connected respectively to said second connecting line so as to be branched therefrom, the other side of each of said first lines on the opposite side to said one side connected respectively to at least those of said plurality of first connecting lines which are connected to the bottom sides of said hydraulic cylinders, a plurality of first flow control means provided respectively in said plurality of first lines for allowing the hydraulic fluid to flow from said other hydraulic pump toward said hydraulic cylinders through variable throttles which control respective flows of the hydraulic fluid to desired throttled flow rates, but cutting off flows of the hydraulic fluid from said hydraulic pump, a third connecting line provided on said front device and connected at one side thereof to said reservoir line and extended so that the other side end portion thereof is positioned at least near said bucket cylinder and at least a part thereof is shared in common as to a discharge of a hydraulic fluid from said boom cylinder, arm cylinder, and bucket cylinder, a plurality of second lines provided on said front device for forming another hydraulic fluid discharging route not passing said flow control valves and each having one end branched from and connected to said third connecting line, the other end of each of said second lines on the opposite side to said one end connected to said third connecting line being connected respectively to at least those of said plurality of first connecting lines which are connected to the bottom sides of said hydraulic cylinders, a plurality of second flow control means provided respectively in said plurality of second lines for allowing the hydraulic fluid to flow from said hydraulic cylinders toward said third connecting line through variable throttles which control respective flows of the hydraulic fluid to desired throttle flow rates, but cutting off flows of the hydraulic fluid from said third connecting line toward said hydraulic cylinders, and third flow control means provided in a line branched from said delivery line within said working machine body for supplying the hydraulic fluid delivered from said other hydraulic pump to said first lines at a desired flow rate and returning the remaining hydraulic fluid to said hydraulic reservoir, said plurality of first lines including a first line for said boom connected to a part of said other side of said second connecting line near said boom cylinder so as to be branched therefrom, a first line for said arm connected to a part of said other side of said second connecting line near said arm cylinder so as to be branched therefrom, and a first line for said bucket connected to a part of said other side of said second connecting line near said bucket cylinder so as to be branched therefrom, said plurality of second lines including a second line for said boom connected to a part of said other side of said third connecting line near said boom cylinder so as to be branched therefrom, a second line for said arm connected to a part of said other side of said third connecting line near said arm cylinder so as to be branched therefrom, and a second line for said bucket connected to a part of said other side of said third connecting line near said bucket cylinder so as to be branched therefrom, said plurality of first flow control means including a first flow control means for said boom provided at a part of said first line for said boom near said boom cylinder, a first flow control means for said arm provided at a part of said first line for said arm near said arm cylinder, and a first flow control means for said bucket provided at a part of said first line for said bucket near said bucket cylinder, said plurality of second flow control means including a second flow control means for said boom provided at a part of said second line f o r said boom near said boom cylinder, a second flow control means for said arm provided at a part of said second line for said arm near said arm cylinder, and a second flow control means for said bucket provided at a part of said second line for said bucket near said bucket cylinder.

2. The hydraulic drive system for hydraulic excavators according to claim 1, wherein the other side of at least one of said first line for said boom, said first line for said arm, and said first line for said bucket on the opposite side to said one side connected to said second connecting line is connected to that of said plurality of first connecting lines which is connected to the rod side of said hydraulic cylinder, and said first flow control means provided in said at least one first line allows t he hydraulic fluid to flow from said other hydraulic pump toward the rod side of said hydraulic cylinder through a variable throttle for controlling a flow of the hydraulic fluid to a desired throttled flow rate, but cuts off a flow of the hydraulic fluid from the rod side of said hydraulic cylinder toward said other hydraulic pump.

3. The hydraulic drive system for hydraulic excavators according to claim 1, wherein the other side of at least one of said first line for said boom, said first line for said arm, and said first line for said bucket on the opposite side to said one side connected to said second connecting line is connected to that of said plurality of first connecting lines which is connected to the rod side of said hydraulic cylinder, said first flow control means provided in said at least one first line allows the hydraulic fluid to flow from said other hydraulic pump toward the rod side of said hydraulic cylinder through a variable throttle for controlling a flow of the hydraulic pump, the other side of at least one of said second line for said boom, said second line for said arm, and said second line for said bucket on the opposite side to said one side connected to said third connecting line is connected to that of said plurality of first connecting lines to which said at lest one first line is connected and which is connected to the rod side of said hydraulic cylinder, and said second flow control means provided in said at least one second line allows the hydraulic fluid to flow from the rod side of said hydraulic cylinder toward said hydraulic reservoir through a variable throttle for controlling a flow of the hydraulic fluid to a desired throttled flow rate, but cuts off a flow of the hydraulic fluid from said hydraulic reservoir toward the rod side of said hydraulic cylinder.

4. The hydraulic drive system for excavators according to claim 1, further comprising control means for controlling said plurality of flow control valves and said first flow control means to be driven in a correlated manner so that just before or after the hydraulic fluid through at least one of said plurality of flow control valves is fully supplied to the corresponding first line, the hydraulic fluid through the corresponding first control means starts to be supplied to the corresponding first connecting line.

5. The hydraulic drive system for hydraulic excavators according to claim 2, further comprising control means for driving said first flow control means disposed in at least one of said plurality of first lines which is connected to the rod side of said hydraulic cylinder, thereby supplying the hydraulic fluid from said other hydraulic pump to the rod side of said hydraulic cylinder, and at the same time driving said second flow control means disposed in the second line which is connected to the bottom side of the corresponding hydraulic cylinder, thereby draining the return hydraulic fluid from the bottom side of the corresponding hydraulic cylinder to said hydraulic reservoir.

6. The hydraulic drive system for hydraulic excavators according to claim 1, further comprising a plurality of operating means which output operation signals for controlling respective stroke amounts of said plurality of flow control valves and control means for receiving said output operation signals from said operating means and controlling said flow control valves and said first flow control means to be driven in a correlated manner, said control means operating in a manner such that in a first input amount area where input amounts of said operating means are relatively small, said flow control valves are moved over strokes at a relatively small ratio with respect to an increase of the input amounts of said operating means, thereby supplying the hydraulic fluid to the corresponding first connecting lines, and that in a second input amount area where the input amounts of said operating means are relatively large, said flow control valves are moved over strokes at a relatively large ratio with respect to an increase of the input amounts of said operating means to control the flow rate of said flow control valves, thereby supplying the hydraulic fluid to the corresponding first connecting lines, and said first flow control means are moved over strokes at a predetermined ratio with respect to an increase of the input amounts of said operating means, thereby supplying the hydraulic fluid to the corresponding first connecting lines through the corresponding first lines.

* * * * *